US010101680B2

(12) United States Patent
Tsuchihashi

(10) Patent No.: US 10,101,680 B2
(45) Date of Patent: Oct. 16, 2018

(54) ELECTROSTATIC LATENT IMAGE DEVELOPING TONER

(71) Applicant: KYOCERA Document Solutions Inc., Osaka (JP)

(72) Inventor: Kazuki Tsuchihashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/576,152

(22) PCT Filed: Dec. 14, 2016

(86) PCT No.: PCT/JP2016/087146

§ 371 (c)(1),
(2) Date: Nov. 21, 2017

(87) PCT Pub. No.: WO2017/168863

PCT Pub. Date: Oct. 5, 2017

(65) Prior Publication Data

US 2018/0157185 A1 Jun. 7, 2018

(30) Foreign Application Priority Data

Mar. 29, 2016 (JP) ..... 2016-065977

(51) Int. Cl.

| | |
|---|---|
| ***G03G 9/08*** | (2006.01) |
| ***G03G 9/087*** | (2006.01) |
| ***G03G 9/093*** | (2006.01) |

(52) U.S. Cl.

CPC ..... *G03G 9/0821* (2013.01); *G03G 9/08* (2013.01); *G03G 9/087* (2013.01); *G03G 9/09321* (2013.01); *G03G 9/09364* (2013.01); *G03G 9/09371* (2013.01)

(58) Field of Classification Search

CPC ..... G03G 9/0821; G03G 9/09364; G03G 9/09371; G03G 9/09321; G03G 9/087; G03G 9/08

See application file for complete search history.

(56) References Cited

FOREIGN PATENT DOCUMENTS

JP 2014-228768 A 12/2014

*Primary Examiner* — Thorl Chea

(74) *Attorney, Agent, or Firm* — Studebaker & Brackett PC

(57) ABSTRACT

An electrostatic latent image developing toner includes a plurality of toner particle each including a toner mother particle and silica particles attached to a surface of the toner mother particle. The toner mother particle includes a toner core and a shell layer. The shell layer includes a first domain substantially formed from a first resin and a second domain substantially formed from a second resin. Both the first resin and the silica particles have higher positive chargeability than the second resin. A shell coverage is at least 40% and no greater than 90%. The toner particles each have an average value of surface potentials measured using a scanning probe microscope of at least +50 mV and no greater than +350 mV and a standard deviation thereof of no greater than 120 mV.

10 Claims, 2 Drawing Sheets

ELECTROSTATIC LATENT IMAGE DEVELOPING TONER

TECHNICAL FIELD

The present invention relates to electrostatic latent image developing toners and in particular relates to capsule toners.

BACKGROUND ART

There is disclosed for example in Patent Literature 1 measurement of surface potentials of a toner particle included in a toner using a scanning probe microscope. Specifically, Patent Literature 1 discloses that the average value of surface potentials of the toner particle is set to be at least −3.0 V and no greater than −0.5 V and a region having a minus potential is set to occupy 95% or more of a surface region of the toner particle. Furthermore, a toner producing method disclosed in Patent Literature 1 uses a charge control agent (calixarene) for adjusting the chargeability of the toner.

CITATION LIST

Patent Literature

[Patent Literature 1] Japanese Patent Application Laid-Open Publication No. 2014-228768

SUMMARY OF INVENTION

Technical Problem

However, it is difficult to provide an electrostatic latent image developing toner that is excellent in heat-resistant preservability and low-temperature fixability and with use of which a high-quality image (specifically, an image having high dot reproducibility and low fogging density) can be formed even according to the toner configuration and the toner producing method disclosed in Patent Literature 1. It is thought to be difficult to ensure sufficient heat-resistant preservability and low-temperature fixability of the toner having the configuration disclosed in Patent Literature 1. It is also thought that dot reproducibility is impaired in the presence of a reverse charging region in the toner disclosed in Patent Literature 1.

The present invention has been made in view of the foregoing and has its object of providing an electrostatic latent image developing toner that is excellent in heat-resistant preservability and low-temperature fixability and with use of which a high-quality image (for example, an image having high dot reproducibility and low fogging density) can be formed.

Solution to Problem

An electrostatic latent image developing toner according to the present invention includes a plurality of toner particles each including a toner mother particle and silica particles attached to a surface of the toner mother particle. The toner mother particle includes a core containing a binder resin and a shell layer covering a surface of the core. The shell layer includes a first domain substantially formed from a first resin and a second domain substantially formed from a second resin. Both the first resin and the silica particles have higher positive chargeability than the second resin. A ratio of a total area of a first covered region that is a surface region of the core covered with the first domain and a second covered region that is a surface region of the core covered with the second domain relative to an area of an entire surface of the core is at least 40% and no greater than 90%. The toner particles each have an average value of surface potentials measured using a scanning probe microscope of at least +50 mV and no greater than +350 mV and a standard deviation thereof of no greater than 120 mV.

Advantageous Effects of Invention

According to the present invention, an electrostatic latent image developing toner can be provided that is excellent in heat-resistant preservability and low-temperature fixability and with use of which a high-quality image (for example, an image having high dot reproducibility and low fogging density) can be formed.

DESCRIPTION OF EMBODIMENTS

Figure 1:
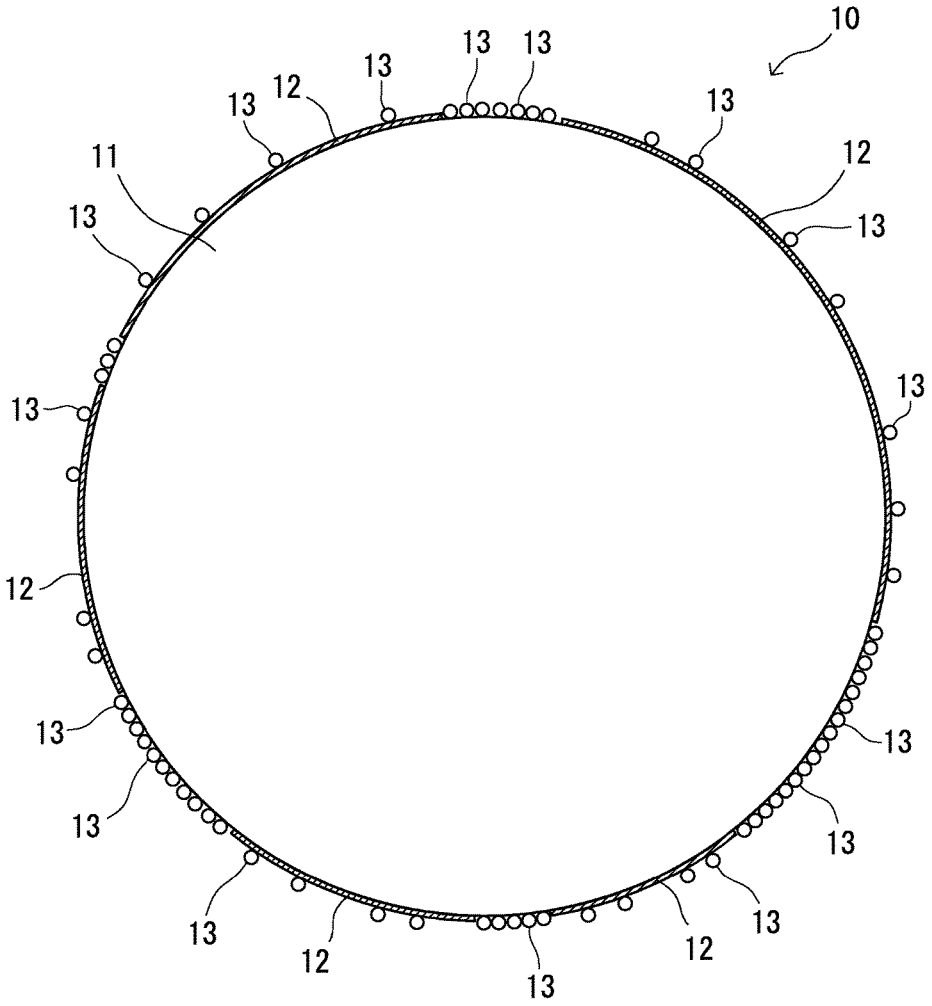
FIG. 1 is a diagram illustrating an example of a cross-sectional configuration of a toner particle included in an electrostatic latent image developing toner according to an embodiment of the present invention.

The following describes in detail an embodiment of the present disclosure. Unless otherwise stated, evaluation results (for example, values indicating shape and physical properties) for a powder (specific examples include toner cores, toner mother particles, an external additive, and a toner) are number averages of values measured for a suitable number of average particles selected from the powder.

Also, unless otherwise stated, a number average particle diameter of a powder is a number average value of equivalent circle diameters of primary particles of the powder (diameters of circles having the same areas as projected areas of the respective particles) measured using a microscope. Furthermore, measurement values for volume median diameter ($D_{50}$) of a powder were measured using a Coulter Counter Multisizer 3 produced by Beckman Coulter, Inc. unless otherwise stated. Acid values and hydroxyl values were measured in accordance with Japanese Industrial Standard (JIS) K0070-1992 unless otherwise stated. Measurement values for number average molecular weight (Mn) and mass average molecular weight (Mw) were measured by gel permeation chromatography unless otherwise stated.

Unless otherwise stated, chargeability refers to chargeability at triboelectric charging. The level of positive chargeability (or negative chargeability) at the triboelectric charging can be determined using for example a known triboelectric series.

Both non-treated silica particles (also referred to below as a silica base) and silica-particles that are silica bases subjected to surface treatment (surface-treated silica particles)

are referred to as "silica particles" in the present description. Moreover, silica particles hydrophobized with a surface preparation agent may be referred to as hydrophobic silica particles and silica particles made to be positively chargeable with a surface preparation agent may be referred to as positively chargeable silica particles.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Also, the term "(meth)acryloyl" is used as a generic term for both acryloyl ($CH_2$═CH—CO—) and (meth)acryloyl ($CH_2$═C($CH_3$)—CO—). Subscripts "n" of respective repeating units in chemical formulas each represent, independently of one another, the number of repetitions (the number of moles) of the repeating unit. Unless otherwise stated, n (the number of repetitions) is any suitable value.

A toner according to the present embodiment can be favorably used for example as a positively chargeable toner for development of an electrostatic latent image. The toner according to the present embodiment is a powder including a plurality of toner particles (particles each having features describe later). The toner may be used as a one-component developer. Alternatively, the toner may be mixed with a carrier using a mixer (a specific example is a ball mill) in order to prepare a two-component developer. A ferrite carrier (powder of ferrite particles) is preferably used as the carrier in order to form a high-quality image. In order to form high-quality images durable for a long period of term, magnetic carrier particles are preferably used each of which includes a carrier core and a resin layer covering the carrier core. Carrier cores may be made from a magnetic material (for example, ferrite) or a resin in which magnetic particles are dispersed in order to impart magnetism to the carrier particles. Alternatively, magnetic particles may be dispersed in the resin layer covering the carrier core. The amount of the toner in the two-component developer is preferably at least 5 parts by mass and no greater than 15 parts by mass relative to 100 parts by mass of the carrier in order to form a high-quality image. Note that the positively chargeable toner is positively charged by friction with the carrier.

The toner particles included in the toner according to the present embodiment each include a toner mother particle and an external additive (powder of external additive particles) attached to a surface of the toner mother particle. The external additive includes silica particles. The toner mother particle includes a core (also referred to below as a toner core) and a shell layer (capsule layer) covering a surface of the toner core. For example, when a toner core that melts at low temperature is covered with a shell layer excellent in heat resistance, both heat-resistant preservability and low-temperature fixability can be imparted to the toner. The toner core contains a binder resin. The toner core may optionally contain an internal additive (for example, a colorant, a releasing agent, a charge control agent, and a magnetic powder). The external additive is attached to a surface of the shell layer or a surface region of the toner core that is not covered with the shell layer. A material for forming the toner cores is also referred to below as a toner core material. A material for forming the shell layers is also referred to below as a shell material.

The toner according to the present embodiment can be used for example for image formation using an electrophotographic apparatus (image forming apparatus). The following describes an example of an image forming method using the electrophotographic apparatus.

First, an image forming section (for example, a charger and an exposure device) of the electrophotographic apparatus forms an electrostatic latent image on a photosensitive member (for example, a surface layer portion of a photosensitive drum) based on image data. Subsequently, a developing device of the electrophotographic apparatus (specifically, a developing device loaded with a developer containing a toner) supplies the toner to the photosensitive member to develop the electrostatic latent image on the photosensitive member. The toner is charged by friction with the carrier, a developing sleeve, or a blade in the developing device before being supplied to the photosensitive member. For example, the positively chargeable toner is positively charged. In the developing process, toner (specifically, charged toner) on the development sleeve disposed in the vicinity of the photosensitive member (for example, a surface layer portion of a development roller of the developing device) is supplied to the photosensitive member and attached to the electrostatic latent image on the photosensitive member, thereby forming a toner image on the photosensitive member. Toner is supplied to the developing device from a toner container containing toner for replenishment use to make up for consumed toner.

In a subsequent transfer process, a transfer device of the electrophotographic apparatus transfers the toner image on the photosensitive member to an intermediate transfer member (for example, a transfer belt) and further transfers the toner image on the intermediate transfer member to a recording medium (for example, paper). Thereafter, a fixing device (fixing method: nip fixing using a heating roller and a pressure roller) of the electrophotographic apparatus applies heat and pressure to the toner to fix the toner to the recording medium. Through the above process, an image is formed on the recording medium. A full-color image can be formed for example by superimposing toner images formed using different colors, such as black, yellow, magenta, and cyan. A direct transfer process may alternatively be employed, which involves direct transfer of the toner image from the photosensitive member to the recording medium without the use of the intermediate transfer member. The fixing method may be belt fixing.

The toner according to the present embodiment is an electrostatic latent image developing toner having the following features (also referred to below as basic features).

(Basic Features of Toner)

The electrostatic latent image developing toner includes a plurality of toner particles each including a toner mother particle (a toner core and a shell layer) and silica particles attached to a surface of the toner mother particle. The shell layer includes a first domain substantially formed from a first resin and a second domain substantially formed from a second resin. Both the first resin and the silica particles have higher positive chargeability than the second resin. A ratio of a total area of a surface region of the toner core that is covered with the first domain (also referred to below as a first covered region) and a surface region of the toner core that is covered with the second domain (also referred to below as a second covered region) relative to an area of an entire surface region of the toner core is at least 40% and no greater than 90%. The toner particles each have an average value of surface potentials measured using a scanning probe microscope (SPM) of at least +50 mV and no greater than +350 mV and a standard deviation thereof of no greater than 120 mV. The ratio of the total area of the first and second covered regions relative to the area of the entire surface region of the toner core may be also referred to below as a "shell coverage". A region of the surface region of the toner core that is covered with either the first or second domain may be referred to as a "shell covering region" and a region thereof that is covered with neither the first nor second domain may be referred to as a "non-covered region". The shell covering region includes the first and second covered regions.

In the above basic features, the silica particles may be subjected to surface treatment. The shell coverage and the surface potentials of the toner particle were measured according to the same method as those described later in Examples or alternative methods thereof.

The shell layer may be a film with or without granular appearance. In a configuration in which resin particles are used as a material for forming the shell layers, a film without granular appearance as the shell layer is expected to be formed by hardening the material (resin particles) completely melted into a film shape. By contrast, a film in which the resin particles are two-dimensionally connected together (film with granular appearance) is expected to be formed by hardening the material (resin particles) incompletely melted into a film shape. The resin particles for forming the shell layer may have a spherical shape or be deformed into a flat shape in the course of film formation from spherical resin particles. For example, when the resin particles are attached to the surfaces of the toner cores in a liquid and the liquid is heated, the resin particles can be melted (or deformed) into a film shape. Alternatively, film formation of the resin particles may progress through heating in a drying process or receiving physical impact in an external addition process. The shell layer may be a single film or be aggregation of a plurality of film fragments (spots) that are separate from one another.

The first domain may be formed from the first resin or an additive may be dispersed in the first resin forming the first domain. Also, the second domain may be formed from the second resin or an additive may be dispersed in the second resin forming the second domain.

The first covered region (region of the surface region of the toner core that is covered with the first domain) in the above basic features refers to a region where the first domain is in direct contact with the surface of the toner core. The second covered region (region of the surface region of the toner core that is covered with the second domain) refers to a region where the second domain is in direct contact with the surface of the toner core. Accordingly, a region of the surface region of the toner core where the first domain is in direct contact with the surface of the toner core equates with the first covered region even in a state in which the second domain covers the first domain.

The area of the shell covering region (region of the surface region of the toner core that is covered with either the first or second domain) equates with a total area of the first and second covered regions. In the above basic features, the shell coverage (unit: %) is expressed by an expression "(shell coverage)=100×(area of shell covering region)/(area of entire surface region of toner core)". The shell coverage measuring method is the same as that described later in Examples or an alternative method thereof.

The shell coverage of at least 40% and no greater than 90% is advantageous in order that the toner has both heat-resistant preservability and low-temperature fixability. A too large shell coverage may cause difficulty in ensuring sufficient low-temperature fixability of the toner. A too small shell coverage may cause difficulty in ensuring sufficient heat-resistant preservability of the toner. Further, in a configuration in which the toner core has high negative chargeability, a too small shell coverage may cause difficulty in ensuring sufficient positive chargeability of the toner. When the positive chargeability of the toner is insufficient in a situation in which an image is formed with the positively chargeable toner, a part of the surface of the toner particle may be reversely (negatively) charged, with the result that fogging tends to occur.

When the silica particles are attached to the surface of the toner mother particle, fluidity of the toner can be improved. When the positively chargeable silica particles are attached to the surface of the toner mother particle, positive chargeability of the toner particle can be increased. However, fogging tends to occur in image formation with use of a toner in which the toner core is covered with a homogenous resin film and the positively chargeable silica particles are attached to the surface of the resin film. The present inventor has inferred that a cause of the above lies in wide dispersion in level of the positive chargeability in the surface of the toner particle. A region of the surface region of the resin film to which the silica particles are attached is thought to have higher positive chargeability than a region to which the silica particles are not attached.

The shell layer of the toner having the above basic features includes the first and second domains. Further, both the first resin (resin forming the first domain) and the silica particles have higher positive chargeability than the second resin (resin forming the second resin). The surface region of the toner particle including the shell layer such as above is thought to be roughly categorized into a first region (shell layer: first domain, silica particles: present), a second region (shell layer: first domain, silica particles: absent), a third region (shell layer: second domain, silica particles: present), a fourth region (shell layer: second domain, silica particles: absent), and a fifth region (shell layer: absent, silica particles: present). Both the first domain and the silica particles, both of which have high positive chargeability, are present in the first region. Either the first domain or the silica particles, both of which have high positive chargeability, are present on each of the second, third, and fifth regions. Neither the first domain nor the silica particles, both of which have high positive chargeability, are present in the fourth region. The second, third, and fifth regions thought to have positive chargeability lower than that of the first region and higher than that of the fourth region. The second, third, and fifth regions are thought to have positive chargeability of almost the same level.

The present inventor has found that when the first and fourth regions are reduced while the second, third, and fifth regions are increased, the surface potentials of the toner particle fall in the range defined in the above basic features (average value: at least +50 mV and no greater than +350 mV, standard deviation: no greater than 120 mV). The present inventor has then confirmed that the toner having the above basic features is excellent in heat-resistant preservability and low-temperature fixability and a high-quality image (specifically, image having high dot reproducibility and low fogging density) can be formed with use of the toner (see Table 4 described later).

Note that the standard deviation of the surface potentials of the toner particle measured by SPM is preferably at least 30 mV in order to ensure sufficient production ease (specifically, production ease in view of cost or technique) of the toner.

Figure 2:
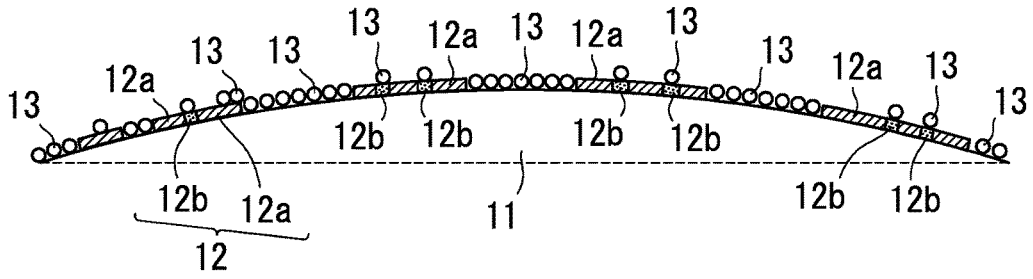
FIG. 2 is a diagram illustrating an example of a cross-sectional configuration of a shell layer in the electrostatic latent image developing toner according to the embodiment of the present invention.

The following describes a configuration of the toner particle included in the toner having the above basic features with reference to FIGS. 1 and 2. FIG. 1 illustrates an example of the configuration of the toner particle included in the toner according to the present embodiment. FIG. 2 is a diagram illustrating the surface of the toner particle in an enlarged scale.

A toner particle 10 illustrated in FIG. 1 includes a toner core 11, a shell layer 12 disposed over a surface of the toner core 11, and silica particles 13. The toner core 11 contains a binder resin (including for example a crystalline polyester resin and a non-crystalline polyester resin). The shell layer 12 partially covers the surface of the toner core 11.

As illustrated in FIG. 2, the shell layer 12 includes a first domain 12*a* and a second domain 12*b*. The first domain 12*a* is substantially formed from a resin (first resin). The second domain 12*b* is substantially formed from a resin (second resin). The shell layer 12 is a film as a result of integration of the first and second domains 12*a* and 12*b*. Both the resin forming the first domain 12*a* (for example, an acrylic acid-based resin including at least one repeating unit derived from a (meth)acryloyl group-containing quaternary ammonium compound) and the silica particles 13 (for example, hydrophobic silica particles) have higher positive chargeability than the resin forming the second domain 12*b* (for example, a styrene-acrylic acid-based resin including at least one repeating unit having an alcoholic hydroxyl group).

In the example illustrated in FIG. 2, the silica particles 13 are selectively present in a region of the entire surface region of the toner core 11 that is covered with neither the first domain 12*a* nor the second domain 12*b* (non-covered region) and a region thereof that is covered with the second domain 12*b* (second covered region). In the example illustrated in FIG. 2, the second region (shell layer 12: first domain 12*a*, silica particles: absent), the third region (shell layer 12: second domain 12*b*, silica particles 13: present), and the fifth region (shell layer 12: absent, silica particles 13: present) each occupy large while the first region (shell layer 12: first domain 12*a*, silica particles 13: present) and the fourth region (shell layer 12: second domain 12*b*, silica particles 13: absent) each occupy small.

The present inventor has found the followings through experiments and the like.

Figure 3:
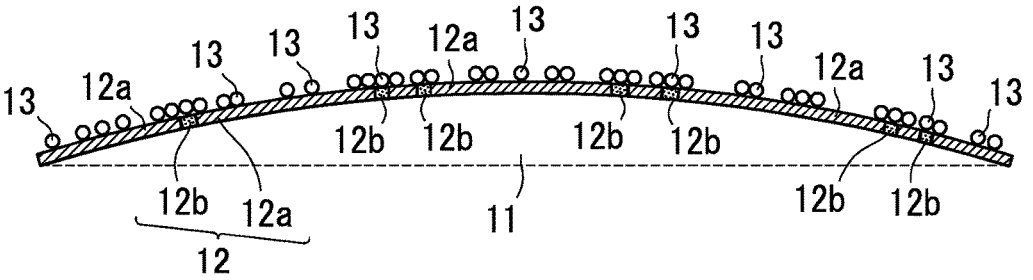
FIG. 3 is a diagram illustrating a cross-sectional configuration of a shell layer in an electrostatic latent image developing toner according to a first comparative example.

In a configuration in which the shell coverage is approximately 100%, the first region occupies large, as illustrated in FIG. 3, with the result that the toner tends to have excessively high positive chargeability. Also, in a configuration in which the shell coverage is approximately 100%, the first domain 12*a* becomes thick, with the result that the toner tends to have excessively high positive chargeability. Further, in a configuration in which the amount of the silica particles 13 is excessively increased, the first region occupies large likewise, with the result that the toner tends to have excessively high positive chargeability. Excessively high positive chargeability of the toner may cause difficulty in ensuring sufficient developability of the toner.

Figure 4:
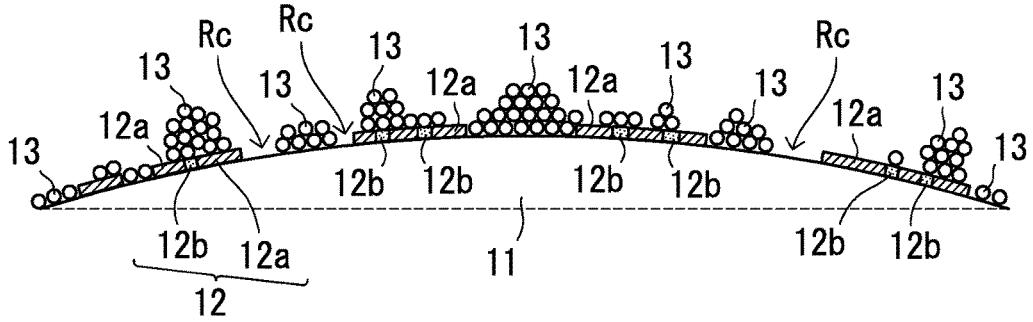
FIG. 4 is a diagram illustrating a cross-sectional configuration of a shell layer in an electrostatic latent image developing toner according to a second comparative example.

As illustrated in FIG. 4, aggregation (insufficient dispersion) of the silica particles 13 may generate a region Rc where the toner core 11 is exposed, with the result that dispersion in positive chargeability on the surface of the toner particle 10 tends to significantly large. Specifically, an aggregating part of the silica particles 13 (lump of the silica particles 13) tends to have excessively high positive chargeability while the region Rc (surface region of the toner core 11 that is covered with neither the shell layer 12 nor the silica particles 13, which also referred to below as a "exposed core region") tends to have insufficient positive chargeability. In a configuration in which the silica particles 13 have a too large particle diameter, in a situation in which a time period for external addition of the silica particles 13 is insufficient, or in a situation in which the silica particles 13 are not deagglomerated prior to external addition thereof, the silica particles 13 tend to be insufficiently dispersed. In a configuration in which the silica particles 13 have a too large particle diameter, it is thought that electrostatic repulsion among the silica particles 13 causes the region Rc (exposed core region) to be readily generated. When dispersion in positive chargeability on the surface of the toner particle 10 is significantly large, fogging may readily occur in image formation with use of a powder of the toner particles 10.

The present inventor has acquired a toner having the above basic features by precisely adjusting production conditions base on the above findings. The toner particle 10 had almost the same configuration as that illustrated in FIG. 2. Examples of conditions for producing the shell layers 12 include types and additive amounts of resins contained therein. Examples of conditions for producing the silica particles 13 include types, additive amounts, pre-treatment, and external addition conditions of the silica particles. The resin forming the first domain (first resin) preferably has a glass transition point (Tg) of at least 80° C. in order to increase selective adherence to the second domain (specifically, in order that the silica particles are made to be selectively attached more readily to the second domain than to the first domain). The lower Tg of the shell layer is, the higher adhesiveness of the shell layer is. As a result, the silica particles tend to be readily attached to the shell layer. In a configuration in which the resin forming the first domain (first resin) has a Tg of at least 80° C., the silica particles are hardly attached to the first domain and accordingly tend to be attached to the second domain by electrostatic attraction. In order to increase selective adherence to the second domain, the resin forming the first domain (first resin) preferably has a higher Tg than the resin forming the second domain (second resin) and it is further preferable that difference in Tg between the first and second resins is at least 5° C. ((Tg of first resin)−(Tg of second resin) >+5° C.).

Both the resin forming the first domain (first resin) and the silica particles (external additive) preferably have higher positive chargeability than the binder resin of the toner core (in a configuration in which the toner core contains a plurality of resins, a resin among the resins of which amount is the largest in terms of mass) in order to increase selective adherence to the toner core (specifically, in order that the silica particles are selectively attached to the surface of the toner core more readily than to the first domain). Particularly preferably, the toner core contains at least one of a styrene-acrylic acid-based resin and a polyester resin each of which has comparatively high negative chargeability. The silica particles preferably have a number average primary particle diameter of at least 5 nm and no greater than 30 nm in order to increase selective adherence to the toner core and ensure sufficient fluidity of the toner. Furthermore, the silica particles (external additive) preferably have a number average primary particle diameter of at least 10 nm and no greater than 30 nm and more preferably at least 15 nm and no greater than 30 nm in order to satisfy requirements (average value and standard deviation) of the surface potentials of the toner particle defined in the above basic features. A too small particle diameter of the silica particles (external additive) may cause difficulty in impartation of sufficient positive chargeability to the toner particles by the silica particles (external additive).

In order to satisfy the requirements (average value and standard deviation) of the surface potentials of the toner particle defined in the above basic features, it is preferable that: the resin forming the first domain of the shell layer (first resin) has a glass transition point of at least 80° C.; the silica particles have a number average primary particle diameter of at least 10 nm and no greater than 30; and both the first resin and the silica particles have higher positive chargeability than the binder resin contained in the toner core. A preferable example of the toner having the above configuration is a toner in which the silica particles each having no amino group on a surface thereof and the toner core contains either or both a polyester resin and a styrene-acrylic acid-based resin. When positively chargeable silica particles with which an amino group is provided through use of a surface preparation agent are used as an external additive of the toner particle, the toner tends to have excessively high positive chargeability.

It is preferable in the above basic features that the toner core is a pulverized core and contains a crystalline polyester resin and a non-crystalline polyester resin and inorganic particles other than the silica particles are additionally attached to the surface of the toner mother particle in order to obtain a toner suitable for image formation and ensure sufficient producibility of the toner. Typically, toner cores are roughly categorized into a pulverized core (also called a pulverized toner) and a polymerized core (also called a chemical toner). Toner cores produced by a pulverization method belong to the pulverized core, and toner cores produced by an aggregation method belong to the polymerized core. The toner cores in the toner having the above basic features are preferably pulverized cores containing a polyester resin.

A preferable shell material is a polymer (resin) of monomers (resin raw materials) containing at least one vinyl compound. The polymer of the monomers (resin raw materials) containing at least one vinyl compound includes a repeating unit derived from the vinyl compound. Note that the vinyl compound is a compound having a vinyl group ($CH_2{=}CH{-}$) or a group in which a hydrogen in a vinyl group is substituted (specific examples include ethylene, propylene, butadiene, vinyl chloride, acrylic acid, methyl acrylate, methacrylic acid, methyl methacrylate, acrylonitrile, and styrene). The vinyl compound can become a macromolecule (resin) through addition polymerization by carbon double bonding "C=C" included in the vinyl group or the like.

The resin forming the first domain (first resin) preferably includes a repeating unit derived from for example a nitrogen-containing vinyl compound (specific examples include a quaternary ammonium compound and a pyridine compound) and particularly preferably includes a repeating unit represented by the following formula (1).

(1)

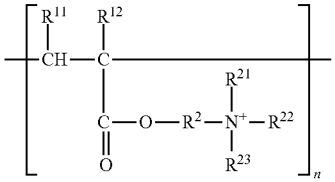

In formula (1), $R^{11}$ and $R^{12}$ each represent, independently of one another, a hydrogen atom, a halogen atom, or an optionally substituted alkyl group. $R^{21}$, $R^{22}$, and $R^{23}$ each represent, independently of one another, a hydrogen atom, an optionally substituted alkyl group, or an optionally substituted alkoxy group. $R^2$ represents an optionally substituted alkylene group. Preferably, $R^{11}$ and $R^{12}$ each represent, independently of one another, a hydrogen atom or a methyl group. A combination of $R^{11}$ representing a hydrogen atom and $R^{12}$ representing a hydrogen atom or a methyl group is particularly preferable. Preferably, $R^{21}$, $R^{22}$, and $R^{23}$ represent, independently of one another, an alkyl group having a carbon number of at least 1 and no greater than 8, and more preferably a methyl group, an ethyl group, an n-propyl group, an iso-propyl group, an n-butyl group, or an iso-butyl group. $R^2$ preferably represents an alkylene group having a carbon number of at least 1 and no greater than 6, and more preferably a methylene group or an ethylene group. Note that in a repeating unit derived from 2-(methacryloyloxy) ethyl trimethylammonium chloride, $R^{11}$ represents a hydrogen atom; $R^{12}$ represents a methyl group; $R^2$ represents an ethylene group; and $R^{21}$ to $R^{23}$ each represent a methyl group.

The resin forming the second domain (second resin) preferably includes for example a repeating unit derived from an acrylic acid-based monomer and particularly preferably a repeating unit represented by the following formula (2). Particularly preferably, the resin forming the first domain (first resin) includes a repeating unit represented by the following formula (2) in addition to the repeating unit represented by formula (1).

(2)

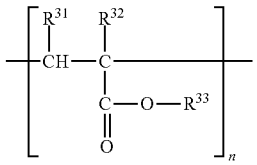

In formula (2), $R^{31}$ and $R^{32}$ each represent, independently of one another, a hydrogen atom, a halogen atom, or an optionally substituted alkyl group. $R^{33}$ represents a hydrogen atom or an optionally substituted alkyl group. Preferably, $R^{31}$ and $R^{32}$ each represent, independently of one another, a hydrogen atom or a methyl group. A combination of $R^{31}$ representing a hydrogen atom and $R^{32}$ representing a hydrogen atom or a methyl group is particularly preferable. $R^{33}$ particularly preferably represents a hydrogen atom or an alkyl group having a carbon number of at least 1 and no greater than 4. Note that in a repeating unit derived from methyl methacrylate, $R^{31}$ represents a hydrogen atom and $R^{32}$ and $R^{33}$ each represent a methyl group.

The resin forming the second domain (second resin) preferably includes for example a repeating unit derived from a styrene-based monomer and particularly preferably a repeating unit represented by the following formula (3).

(3)

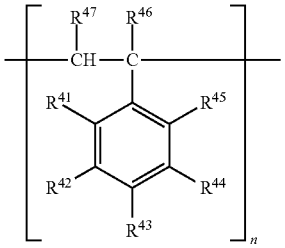

In formula (3), $R^{41}$ to $R^{45}$ each represent, independently of one another, a hydrogen atom, a halogen atom, a hydroxyl group, an optionally substituted alkyl group, an optionally substituted alkoxy group, or an optionally substituted aryl group. $R^{46}$ and $R^{47}$ each represent, independently of one another, a hydrogen atom, a halogen atom, or an optionally substituted alkyl group. $R^{41}$ to $R^{45}$ each represent, independently of one another, a hydrogen atom, a halogen atom, an alkyl group having a carbon number of at least 1 and no greater than 4, an alkoxy group having a carbon number of at least 1 and no greater than 4, or an alkoxyalkyl group having a carbon number (specifically, a total carbon number of alkoxy and alkyl) of at least 2 and no greater than 6. Preferably, $R^{46}$ and $R^{47}$ each represent, independently of one another, a hydrogen atom or a methyl group. A combination of $R^{47}$ representing a hydrogen atom and $R^{46}$ representing a hydrogen atom or a methyl group is particularly preferable. Note that $R^{41}$ to $R^{47}$ each represent a hydrogen atom in a repeating unit derived from styrene.

In order that the toner has the above basic features, the resin forming the second domain (second resin) preferably includes in chemical structure thereof no nitrogen atom and a repeating unit having at least one group selected from the group consisting of an ether group (—O—), a carbonyl group (—CO—), and a hydroxyl group (—OH) with a repeating unit represented by the following formula (4) being particularly preferable. The carbonyl group (—CO—) may be included in the repeating unit in the form of an ester group (—COO—) or a carboxyl group (—COOH). The present inventor has found that when the resin forming the second domain (second resin) includes at least one repeating unit having an alcoholic hydroxyl group (for example, a repeating unit represented by the following formula (4)), the toner core can be easily covered with the shell layer at a high coverage ratio.

(4)

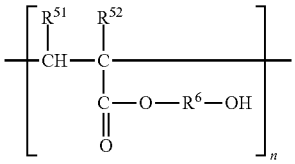

In formula (4), $R^{51}$ and $R^{52}$ each represent, independently of one another, a hydrogen atom, a halogen atom, or an optionally substituted alkyl group. $R^{6}$ represents an optionally substituted alkylene group. Preferably, $R^{51}$ and $R^{52}$ each represent, independently of one another, a hydrogen atom or a methyl group. A combination of $R^{51}$ representing a hydrogen atom and $R^{52}$ representing a hydrogen atom or a methyl group is particularly preferable. $R^{6}$ preferably represents an alkylene group having a carbon number of at least 1 and no greater than 6 and more preferably an alkylene group having a carbon number of at least 1 and no greater than 4. Note that in a repeating unit derived from 2-hydroxybutyl methacrylate, $R^{51}$ represents a hydrogen atom, $R^{52}$ represents a methyl group, and $R^{6}$ represents a butylene group (—$CH_2CH(C_2H_5)$—).

In order that the toner has both heat-resistant preservability and low-temperature fixability, the resin forming the second domain (second resin) preferably includes at least one repeating unit selected from the group consisting of the repeating unit represented by formula (2), the repeating unit represented by formula (3), and the repeating unit represented by formula (4), more preferably includes at least the repeating unit represented by formula (2) and the repeating unit represented by formula (3), and further preferably includes all of the repeating unit represented by formula (2), the repeating unit represented by formula (3), and the repeating unit represented by formula (4).

The toner according to the present embodiment includes the plurality of toner particles defined in the above basic features (also referred to below as toner particles of the present embodiment). It is thought that the toner including the plurality of toner particles of the present embodiment is excellent in heat-resistant preservability and low-temperature fixability and a high-quality image (for example, an image having high dot reproducibility and low fogging density) can be formed with use of the toner (see Tables 1 to 4 described later). Note that in order to achieve such advantages, the toner preferably includes the toner particles of the present embodiment at a ratio of at least 80% by number, more preferably at least 90% by number, and further preferably 100% by number. Toner particles each including no shell layer may be included in the toner in addition to the toner particles of the present embodiment.

The binder resin as a main component (specifically, at a ratio of 50% by mass or more) of the toner cores preferably has a glass transition point (Tg) of at least 20° C. and no greater than 60° C. in order that the toner has both heat-resistant preservability and low-temperature fixability. The binder resin as the main component (specifically, at a ratio of 50% by mass or more) of the toner cores preferably has a softening point (Tm) of at least 80° C. and no greater than 145° C. in order that the toner has both heat-resistant preservability and low-temperature fixability. Note that respective methods for measuring Tg and Tm are the same as those described later in Examples or alternative methods thereof.

The toner preferably has a volume median diameter ($D_{50}$) of at least 3 μm and less than 10 μm in order that the toner has both heat-resistant preservability and low-temperature fixability.

The toner core (the binder resin and an internal additive), the shell layer, and the external additive will be described next in stated order. A component (for example, the internal additive) that is not necessary may be omitted according to the purpose of the toner.

[Toner Core]

(Binder Resin)

The binder resin is typically a main component (for example, at least 85% by mass) of the toner cores. Properties of the binder resin are therefore expected to have great influence on an overall property of the toner cores. Combinational use of a plurality of resins as the binder resin can result in adjustment of properties (specific examples include hydroxyl value, acid value, Tg, and Tm) of the binder resin. The toner cores have a strong tendency to be anionic when the binder resin has a group such as an ester group, a hydroxyl group, an ether group, or an acid group. By contrast, the toner cores have a strong tendency to be cationic when the binder resin has a group such as an amino group or an amide group. In order to increase reactivity between the toner core and the shell layer, the hydroxyl value and the acid value of the binder resin each are preferably at least 10 mgKOH/g.

For example, the following thermoplastic resins are preferable as the binder resin of the toner cores.

<Preferable Thermoplastic Resins>

Preferable examples of the binder resin include styrene-based resins, acrylic acid-based resins (specific examples include an acrylic acid ester polymer and a methacrylic acid ester polymer), olefin-based resins (specific examples include a polyethylene resin and a polypropylene resin), vinyl chloride resins, polyvinyl alcohol, vinyl ether resins, N-vinyl resins, polyester resins, polyamide resins, and urethane resins. A copolymer of any of the resins listed above, that is, a copolymer of any of the resins listed above into which an optional repeating unit is introduced (specific examples include a styrene-acrylic acid-based resin and a styrene-butadiene-based resin) is also preferable as the binder resin.

The styrene-acrylic acid-based resin is a copolymer of at least one styrene-based monomer and at least one acrylic acid-based monomer. Styrene-based monomers and acrylic acid-based monomers listed below are preferably used for synthesis of the styrene-acrylic acid-based resin. Use of an acrylic acid-based monomer having a carboxyl group can result in introduction of the carboxyl group into a resultant styrene-acrylic acid-based resin. Use of a monomer having a hydroxyl group (specific examples include p-hydroxystyrene, m-hydroxystyrene, and hydroxyalkyl (meth)acrylate) can result in introduction of the hydroxyl group into a resultant styrene-acrylic acid-based resin. The acid value of the resultant styrene-acrylic acid-based resin can be adjusted through appropriate adjustment of the amount of the acrylic acid-based monomer to use. The hydroxyl value of the resultant styrene-acrylic acid-based resin can be adjusted through appropriate adjustment of the amount of the monomer having the hydroxyl group to use.

Preferable examples of the styrene-based monomers include styrene, alkylstyrenes (specific examples include a-methylstyrene, 4-methylstyrene, 4-ethylstyrene, and 4-butylstyrene), alkoxystyrenes (a specific example is 4-methoxystyrene), hydroxystyrenes (specific examples include 3-hydroxystyrene and 4-hydroxystyrene), and halogenated styrenes.

Preferable examples of the acrylic acid-based monomers include (meth)acrylic acid, (meth)acrylic acid alkyl esters, and (meth)acrylic acid hydroxyalkyl esters. Preferable examples of the (meth)acrylic acid alkyl esters include methyl (meth)acrylate, ethyl (meth)acrylate, n-propyl (meth)acrylate, iso-propyl (meth)acrylate, n-butyl (meth) acrylate, iso-butyl (meth)acrylate, and 2-ethylhexyl (meth) acrylate. Preferable examples of the (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

The polyester resin can be obtained by condensation polymerization of at least one polyhydric alcohol and at least one polybasic carboxylic acid. Examples of alcohols that can be used for synthesis of the polyester resin include dihydric alcohols (specific examples include aliphatic diols and bisphenols) and tri- or higher-hydric alcohols that are listed below. Examples of carboxylic acids that can be used for synthesis of the polyester resin include dibasic carboxylic acids and tri- or higher-basic carboxylic acids that are listed below. The acid value and the hydroxyl value of the polyester resin can be adjusted through appropriate adjustment of the respective amounts of the alcohol and the carboxylic acid to use in synthesis of the polyester resin. Increasing the molecular weight of the polyester resin tends to decrease the acid value and the hydroxyl value of the polyester resin.

Preferable examples of the aliphatic diols include diethylene glycol, triethylene glycol, neopentyl glycol, α,ω-alkanediols (specific examples include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5 -trihydroxymethylbenzene.

Preferable examples of the dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenylsuccinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and dicycloalkane carboxylic acids (a specific example is cyclohexanedicarboxylic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The toner cores preferably contain one of the resins listed in "Preferable Thermoplastic Resins" as the binder resin in order that the toner has both heat-resistant preservability and low-temperature fixability, and particularly preferably contains either or both the polyester resin and the styrene-acrylic acid-based resin. The toner cores may contain a crystalline polyester resin and a non-crystalline polyester resin as the binder resin. The crystalline polyester resin has a tendency to melt to drastically decrease its viscosity at a specific temperature when heated in a solid state. Further, the crystalline polyester resin tends to be compatible with the non-crystalline polyester resin. The toner cores particularly preferably contain at least one crystalline polyester resin and at least one non-crystalline polyester resin that are melt-kneaded together as the binder resin in order that the toner has both heat-resistant preservability and low-temperature fixability.

A preferable example of the crystalline polyester resin is a polymer of monomers (resin raw materials) including at least one α,ω-alkanediol having a carbon number of at least 1 and no greater than 8 (for example, two α,ω-alkanediols: 1,4-butanediol having a carbon number of 4 and 1,6-hexanediol having a carbon number of 6), at least one α,ω-alkanedicarboxylic acid having a carbon number (including two carbons of the carboxyl groups) of at least 4 and no greater than 10 (for example, succinic acid having a carbon number of 4), at least one styrene-based monomer (for example, styrene), and at least one acrylic acid-based monomer (for example, acrylic acid)

In a configuration in which the toner cores contain a crystalline polyester resin as the binder resin, the crystalline polyester resin preferably has a crystallinity index of at least 0.90 and no greater than 1.50 in order to improve low-temperature fixability of the toner. A crystalline polyester resin having a crystallinity index in the above range is excellent in shape meltability. Note that the crystallinity index is a ratio (=Tm/Mp) of a softening point (Tm) relative to a melting pint (Mp). Respective methods for measuring Mp and Tm are the same as those described later in Examples or alternative methods thereof. Definite Mp of a non-crystalline polyester resin cannot be measured in many cases. The crystallinity index of a polyester resin can be adjusted by changing the type or amount of a material (for example, either or both the alcohol and the carboxylic acid) for synthesis of the polyester resin.

In order that the toner has both heat-resistant preservability and low-temperature fixability, the toner cores preferably contain a plurality of non-crystalline polyester resins having different softening points (Tm), and particularly preferably contain a non-crystalline polyester resin having a softening point of no greater than 90° C., a non-crystalline polyester resin having a softening point of at least 100° C. and no greater than 120° C., and a non-crystalline polyester resin having a softening point of at least 125° C.

A preferable example of the non-crystalline polyester resin having a softening point of no greater than 90° C. is a non-crystalline polyester resin containing a bisphenol (for example, either or both bisphenol A ethylene oxide adduct and bisphenol A propylene oxide adduct) as an alcohol component and an aromatic dicarboxylic acid (for example, terephthalic acid) and an unsaturated dicarboxylic acid (for example, fumaric acid) as acid components.

A preferable example of the non-crystalline polyester resin having a softening point of at least 100° C. and no greater than 120° C. is a non-crystalline polyester resin containing a bisphenol (for example, either or both bisphenol A ethylene oxide adduct and bisphenol A propylene oxide adduct) as an alcohol component and an aromatic dicarboxylic acid (for example, terephthalic acid) as an acid component and not containing an unsaturated dicarboxylic acid.

A preferable example of the non-crystalline polyester resin having a softening point of at least 125° C. is a non-crystalline polyester resin containing a bisphenol (for example, either or both bisphenol A ethylene oxide adduct and bisphenol A propylene oxide adduct) as an alcohol component and a dicarboxylic acid having an alkyl group having a carbon number of at least 10 and no greater than 20 (for example, a dodecylsuccinic acid having an alkyl group having a carbon number of 12), an unsaturated dicarboxylic acid (for example, fumaric acid), and a tri-basic carboxylic acid (for example, trimellitic acid) as acid components.

In a configuration in which a non-crystalline polyester resin is used as the binder resin of the toner cores, the non-crystalline polyester resin preferably has a number average molecular weight (Mn) of at least 1,000 and no greater than 2,000 in order to improve strength of the toner cores and fixability of the toner. The non-crystalline polyester resin preferably has a molecular weight distribution (ratio Mw/Mn of mass average molecular weight (Mw) relative to number average molecular weight (Mn)) of at least 9 and no greater than 21.

(Colorant)

The toner cores may optionally contain a colorant. The colorant can be a known pigment or dye that matches the color of the toner. The amount of the colorant is preferably at least 1 part by mass and no greater than 20 parts by mass relative to 100 parts by mass of the binder resin in order that a high-quality image is formed with use of the toner.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can be used for example as a yellow colorant. Specific examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as a magenta colorant. Specific examples of magenta colorants that can be preferably used include C.I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, or 254).

One or more compounds selected from the group consisting of copper phthalocyanine compounds, anthraquinone compounds, and basic dye lake compounds can be used for example as a cyan colorant. Specific examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may optionally contain a releasing agent. The releasing agent is for example used in order to improve fixability of the toner or resistance of the toner to being offset. The toner cores are preferably produced with use of an anionic wax in order to increase anionic strength of the toner cores. The amount of the releasing agent is preferably at least 1 part by mass and no greater than 30 parts by mass relative to 100 parts by mass of the binder resin in order to improve fixability or offset resistance of the toner.

Examples of releasing agents that can be preferably used include aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One of the releasing agents listed above may be used, or two or more of the releasing agents listed above may be used in combination.

A compatibilizer may be added to the toner cores in order to improve compatibility between the binder resin and the releasing agent.

(Charge Control Agent)

The toner cores may optionally contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased by containing a negatively chargeable charge control agent in the toner cores. By contrast, the cationic strength of the toner cores can be increased by containing a positively chargeable charge control agent in the toner cores. However, the toner cores need not contain a charge control agent in a configuration in which sufficient chargeability of the toner can be ensured.

(Magnetic Powder)

The toner cores may optionally contain a magnetic powder. Examples of materials of the magnetic powder that can be preferably used include ferromagnetic metals (specific examples include iron, cobalt, and nickel) or alloys of ferromagnetic metals, oxides of ferromagnetic metals (specific examples include ferrite, magnetite, and chromium dioxide), and materials subjected to ferromagnetization (a specific example is heat treatment). One type of the magnetic powders listed above may be used, or two or more types of the magnetic powders listed above may be used in combination.

The magnetic powder is preferably subjected to surface treatment in order to inhibit elution of metal ions (e.g., iron ions) from the magnetic powder. When metal ions are eluted to the surfaces of the toner cores in formation of the shell layers on the surfaces of the toner cores under an acidic condition, the toner cores tend to adhere to one another. It is thought that inhibition of elution of metal ions from the magnetic powder can inhibit adhesion of toner cores to one another.

[Shell Layer]

The toner according to the present embodiment has the above basic features. The shell layer includes the first and second domains.

In order to produce a toner excellent in chargeability, heat-resistant preservability, and low-temperature fixability, the resin forming the first domain (first resin) preferably includes at least one repeating unit derived from a nitrogen-containing vinyl compound, and particularly preferably includes at least one repeating unit derived from a (meth) acryloyl group-containing quaternary ammonium compound. Examples of the (meth)acryloyl group-containing quaternary ammonium compound that can be preferably used include (meth)acrylamide alkyltrimethylammonium salts (a specific example is (3-acrylamide propyl)trimethyl ammonium chloride) and (meth)acryloyloxy alkyltrimethylammonium salts (a specific example is 2-(methacryloyloxy)ethyl trimethylammonium chloride)

In order to produce a toner excellent in chargeability, heat-resistant preservability, and low-temperature fixability, the resin forming the second domain (second resin) preferably includes in chemical structure thereof no nitrogen atom and a repeating unit having at least one group selected from the group consisting of an ether group, a carbonyl group, an acid group, and a hydroxyl group, and is preferably a polymer of monomers (resin raw materials) including at least one styrene-based monomer and at least one acrylic acid-based monomer. Examples of the styrene-based monomer that can be preferably used include styrene, alkylstyrenes (specific examples include a-methylstyrene, 4-methylstyrene, and 4-tert-butylstyrene), alkoxystyrenes (a specific example is 4-methoxystyrene), and halogenated styrenes (specific examples include 4-bromostyrene and 3-chlorostyrene).

It is preferable that the resin forming the first domain (first resin) includes at least one repeating unit derived from a nitrogen-containing vinyl compound and the resin forming the second domain (second resin) includes in chemical structure thereof no nitrogen atom and a repeating unit having at least one group selected from the group consisting of an ether group, a carbonyl group, an acid group, and a hydroxyl group in order to satisfy the requirements (average value and standard deviation) of the surface potentials of the toner particle defined in the above basic features. Furthermore, in the toner having the above configuration, it is particularly preferable that the resin forming the first domain (first resin) is an acrylic acid-based resin including at least one repeating unit derived from (meth)acryloyl group-containing quaternary ammonium compound and the resin forming the second domain (second resin) is a polymer of monomers (resin raw materials) including at least one styrene-based monomer and at least one acrylic acid-based monomer.

The resin forming the second domain (second resin) preferably includes at least one repeating unit having an alcoholic hydroxyl group in order to produce a toner excellent in chargeability, heat-resistant preservability, and low-temperature fixability. As a monomer for introducing a repeating unit having an alcoholic hydroxyl group into the resin forming the second domain (second resin), (meth) acrylic acid 2-hydroxy alkyl ester is preferable and 2-hydroxyethyl acrylate (HEA), 2-hydroxy propyl acrylate (HPA), 2-hydroxyethyl methacrylate (HEMA), 2-hydroxy propyl methacrylate, or 2-hydroxybutyl methacrylate is particularly preferable.

[External Additive]

The toner particles according to the present embodiment each include silica particles as an external additive. The silica particles are attached to the surface of the toner mother particle. Unlike the internal additive, the external additive is not present inside the toner mother particle and is selectively present only on the surface of the toner mother particle (surface layer portion of the toner particle). The external additive particles can be attached to the surfaces of the toner mother particles for example by stirring the toner mother particles (powder) and the external additive (powder) together. The toner mother particle and the external additive particles are not chemically reacted together and are bonded together physically rather than chemically. Bonding strength between the toner mother particle and the external additive particles can be adjusted by changing stirring conditions (specific examples include time period and rotational speed of stirring) and particle diameter, shape, and surface condition of the external additive particles.

Inorganic particles other than the silica particles may be additionally attached to the surface of the toner mother particle. Examples of the inorganic particles that can be preferably used include particles of metal oxides (specific examples include alumina, titanium oxide, magnesium oxide, zinc oxide, strontium titanate, and barium titanate). For example, titanium oxide particles are preferably used as the inorganic particles in order to improve polishing characteristics of the toner.

Resin particles substantially formed from a third resin different from both of the first and second resins that form the shell layers (see "Basic Features of Toner" described above) and having a particle diameter (specifically, equivalent circle diameter of each primary particle measured using a microscope) of at least 50 nm and no greater than 150 nm may be additionally attached to the surface of the toner mother particle. The resin particles as above are thought to function as spacers among the toner particles to inhibit aggregation of the toner particles. Furthermore, when aggregation of the toner particles is inhibited, heat-resistant preservability of the toner is thought to be improved. Note that resin particles having a too large particle diameter may tend to be desorbed from the toner particles. In order to appropriately adjust chargeability of the toner, a resin that is more hardly frictionally charged (hardly vary in potential by friction) than both the first resin and the silica particles is preferably used as the third resin forming the resin particles. For example, a cross-linked acrylic acid-based resin (for example, a polymer of monomers (resin raw materials) including at least one (meth)acrylic acid ester and at least one (meth)acrylic acid ester of alkylene glycol) is preferable as the third resin. The cross-linked acrylic acid-based resin preferably has a glass transition point (Tg) of at least 105° C. and no greater than 150° C.

The external additive particles may be subjected to surface treatment. In a configuration for example in which silica particles are used as the external additive particles, either or both hydrophobicity and positive chargeability may be imparted to the surfaces of the silica particles with use of surface preparation agent. Examples of the surface preparation agent that can be preferably used include coupling agents (specific examples include silane coupling agents, titanate coupling agents, and aluminate coupling agents), silazane compounds (specific examples include a chain silazane compound and a cyclic silazane compound), and silicone oils (a specific example is dimethyl silicone oil). A silane coupling agent or a silazane compound is particularly preferable as the surface preparation agent. Preferable examples of the silane coupling agents include silane compounds (specific examples include methyltrimethoxysilane and aminosilane). A preferable example of the silazane compound is hexamethyldisilazane (HMDS).

When the surface of the silica base (non-treated silica particles) is subjected to treatment with a surface preparation agent, multiple hydroxyl groups (-OH) present on the surface of the silica base are partially or fully substituted with a functional group derived from the surface preparation agent. As a result, silica particles having the functional group derived from the surface preparation agent (specifically, functional group stronger in either or both hydrophobicity and positive chargeability than the hydroxyl group) on the surfaces thereof can be obtained. For example, when the surface of the silica base is treated with a silane coupling agent having an amino group, a dehydration condensation reaction ("A (silica base) —OH" +"B (coupling agent) —OH"→"A-O—B"+$H_2O$) is caused between a hydroxyl group of the silane coupling agent (for example, a hydroxyl group generated by hydrolysis of an alkoxy group of the silane coupling agent with water) and a hydroxyl group present on the surface of the silica base. When the silane coupling agent having the amino group is chemically bonded with silica through a reaction as above, the amino group is given to the surfaces of the silica particles, thereby obtaining positively chargeable silica particles. More specifically, the hydroxyl group present on the surface of the silica base is substituted with a functional group having a terminal amino group (a specific example is —O—Si—$(CH_2)_3$—$NH_2$). The silica particles to which the amino group is given tend to have higher positive chargeability than the silica base. Furthermore, when a silane coupling agent having an alkyl group is used, hydrophobic silica particles are obtained. More specifically, the hydroxyl group present on the surface of the silica base can be substituted with a functional group having a terminal alkyl group (a specific example is —O—Si—$CH_3$) by the above dehydration condensation reaction. Silica particles to which a hydrophobic group (alkyl group) is given as above in place of a hydrophilic group (hydroxyl group) tend to have stronger hydrophobicity than the silica base.

Inorganic particles each having a conductive layer may be used as the external additive particles. The conductive layer is for example a film (a specific example is an Sb-doped $SnO_2$ film) made from a metal oxide (also referred to below as a doped metal oxide) to which conductivity is imparted through doping. The conductive layer may contain a conductive material (specific examples include metals, carbon materials, and conductive macromolecules) other than the doped metal oxide.

[Toner Production Method]

The following describes an example of a method for producing the toner having the above basic features. First of all, toner cores are prepared. Subsequently, the toner cores and a shell material are put into a liquid. In order to form homogenous shell layers, the shell material is preferably dissolved or dispersed in the liquid by stirring the liquid containing the shell material. Next, the shell material is caused to react in the liquid to form shell layers (hardened resin layers) on the surfaces of the toner cores. In order to inhibit dissolution or elution of toner core components (particularly, binder resin and releasing agent) during shell layer formation, the formation of the shell layers is preferably carried out in an aqueous medium. The aqueous medium is a medium containing water as a main component (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. Examples of the polar medium in the aqueous medium that can be used include alcohols (specific examples include methanol and ethanol). The aqueous medium has a boiling point of approximately 100° C.

The method for producing the toner according to the present embodiment will be further described below through a more specific example.

(Toner Core Preparation)

In order to easily obtain preferable toner cores, the toner cores are preferably produced by an aggregation method or a pulverization method with the pulverization method being more preferable.

An example of the pulverization method will be described below. First, a binder resin and an internal additive (for example, at least one of a colorant, a releasing agent, a charge control agent, and a magnetic powder) are mixed together. Subsequently, the resultant mixture is melt-knead. The resultant melt-knead substance is pulverized and the resultant pulverized substance is classified. Through the above process, toner cores having a desired particle diameter are obtained.

An example of the aggregation method will be described below. A binder resin, a releasing agent, and a colorant each in the form of fine particles are first caused to aggregate in an aqueous medium containing these fine particles to form particles having a desired particle diameter. As a result, aggregate particles containing the binder resin, the releasing agent, and the colorant are formed. The formed aggregate particles are then heated for coalescing the components contained in the aggregate particles. As a result, a dispersion of toner cores is obtained. Thereafter, unnecessary substances (for example, a surfactant) are removed from the dispersion of the toner cores to obtain the toner cores.

(Shell Layer Formation)

An acidic substance (for example, hydrochloric acid) is added to ion-exchanged water to prepare an aqueous medium having a weak acidity (for example, at a pH of at least 3 and no greater than 5). Subsequently, the toner cores and respective materials for forming the first and second domains of the shell layers (for example, a suspension of the first resin and a suspension of the second resin) are added to the pH-adjusted aqueous medium. The resin particles contained in the suspension of the first resin are for example substantially formed from a polymer of monomers (resin raw materials) containing at least one nitrogen-containing vinyl compound (a specific example is a polymer of acrylic acid ester, methacrylic acid ester, and quaternary ammonium salt). The resin particles contained in the suspension of the second resin is for example substantially formed from a polymer of monomers (resin raw materials) containing a compound having no nitrogen atom in chemical structure thereof (a specific example is a polymer of styrene, acrylic acid ester, and (meth)acrylic acid hydroxyalkyl ester).

The above-mentioned toner cores and the like may be added to the aqueous medium at room temperature or the aqueous medium of which temperature is adjusted at a specific temperature. An appropriate amount of the shell material to be added can be calculated based on the specific surface area of the toner cores. Furthermore, a polymerization accelerator may be added to the aqueous medium in addition to the above-mentioned toner cores and the like.

The resin particles (shell material) are attached to the surfaces of the toner cores in the liquid. Preferably, the toner cores are highly dispersed in the liquid containing the resin particles in order to regularly attach the resin particles to the surfaces of the toner cores. In order to highly disperse the toner cores in the liquid, the liquid may contain a surfactant or be stirred using a powerful stirrer (for example, "Hivis Disper Mix" produced by PRIMIX Corporation). Examples of the surfactant that can be used include sulfate ester salt, sulfonate, phosphate ester salt, and soap.

Next, the liquid containing the toner cores and the resin particles (shell material) is heated to a specific temperature (for example, a temperature of at least 40° C. and no greater than 90° C.) at a specific rate (for example, a rate of at least 0.1° C./minute and no greater than 3.0° C./minute) while being stirred. Thereafter, as needed, the liquid may be kept at the temperature for a specific time period while being stirred. It is thought that the resin particles approach one another to be integral during the temperature of the liquid being kept high (or increasing), thereby forming the shell layers (specifically, films as a result of integration of the first and second domains). As a result, a dispersion of toner mother particles is obtained.

Subsequently, the dispersion of the toner mother particles is cooled to for example normal temperature (approximately 25° C.). The dispersion of the toner mother particles is then filtered for example using a Buchner funnel. Through the above filtration, the toner mother particles are separated (solid-liquid separation) from the liquid to collect a wet cake of the toner mother particles. Next, the resultant wet cake of the toner mother particles is washed. The toner mother particles that have been washed are then dried.

Subsequently, the toner mother particles (powder) and an external additive (powder) are mixed together using a mixer (for example, an FM mixer produced by Nippon Coke & Engineering Co., Ltd.) to attach the external additive to the surfaces of the toner mother particles. The external additive includes silica particles. The silica particles are preferably deagglomerated in advance. External additive particles other than the silica particles may be included in the external additive. The external additive may contain for example resin particles and titanium oxide particles for external additive use.

Note that processes and order in the above-described toner production method may be changed freely in accordance with desired structure, characteristics, and the like of the toner. For example, in a situation in which a material (for example, the shell material) is caused to react in a liquid, the material may be caused to react in the liquid for a specific time period after being added to the liquid or react in the liquid while being added to the liquid through addition of the material to the liquid over a long period of time. The shell material may be added to the liquid as a single addition or may be divided up and added to the liquid as a plurality of additions. The toner may be sifted after the external addition process. Also, non-essential processes may alternatively be omitted. For example, in a situation in which a commercially available product can be used directly as a material among the materials, use of the commercially available product can eliminate the need of preparation of the material. In a method in which reaction for forming the shell layers progresses favorably even without pH adjustment of the liquid, the process of pH adjustment may be omitted. In a method in which no external additive is necessary, the external addition process may be omitted. In a method in which an external additive is not attached to the surfaces of the toner mother particles (i.e., a method in which the external addition process is omitted), the toner mother particles are equivalent to the toner particles. A prepolymer may be used instead of a monomer as either or both the toner core material and the shell material. In order to obtain a desired compound, a salt, ester, hydrate, or anhydride of the compound may be used as a material thereof. Preferably, a large number of the toner particles are formed at the same time in order to produce the toner efficiently. The toner particles produced at the same time are thought to have substantially the same configuration.

EXAMPLES

The following describes examples of the present invention. Table 1 lists toners TA-1 to TA-6, TB-1 to TB-9 (each is an electrostatic latent image developing toner) according to examples or comparative examples. Table 2 lists suspensions A-1 to A-3, B-1, and B-2 used in production of the corresponding toners listed in Table 1.

TABLE 1

| | Shell material | | | | Silica particles | | | | |
|---|---|---|---|---|---|---|---|---|---|
| | Type | | Amount [mL] | | Type (particle | | Amount [parts by | External addition temperature | External addition |
| Toner | A | B | A | B | diameter) | Deagglomeration | mass] | [° C.] | time [min] |
| TA-1 | A-1 | B-1 | 10 | 20 | SA-1 | Subjected | 1.5 | 25 | 10 |
| TA-2 | | | 13 | 26 | (16 nm) | | 1.2 | 25 | 10 |
| TA-3 | | | 7 | 14 | | | 1.5 | 20 | 10 |
| TA-4 | A-2 | B-1 | 15 | 15 | SA-1 (16 nm) | Subjected | 1.2 | 25 | 10 |
| TA-5 | A-1 | B-2 | 7 | 14 | SA-1 (16 nm) | Subjected | 1.2 | 30 | 10 |
| TA-6 | A-1 | B-1 | 10 | 20 | SB (30 nm) | Subjected | 1.2 | 25 | 10 |
| TB-1 | A-1 | B-1 | 14 | 28 | SA-1 | Subjected | 0.9 | 25 | 10 |
| TB-2 | | | 6 | 12 | (16 nm) | | 1.8 | 25 | 10 |
| TB-3 | | | 13 | 26 | | | 1.5 | 30 | 10 |
| TB-4 | A-1 | B-1 | 7 | 14 | SC (7 nm) | Subjected | 1.2 | 25 | 10 |
| TB-5 | A-1 | B-1 | 10 | 20 | SA-1 (16 nm) | Subjected | 1.5 | 25 | 5 |
| TB-6 | | | | | SA-2 (16 nm) | Not subjected | 1.5 | 25 | 10 |
| TB-7 | | | | | SD (40 nm) | Subjected | 1.5 | 25 | 10 |
| TB-8 | A-3 | B-1 | 10 | 20 | SA-1 (16 nm) | Subjected | 1.5 | 25 | 10 |
| TB-9 | A-3 | B-1 | 8 | 24 | SA-1 (16 nm) | Subjected | 1.5 | 20 | 10 |

The term "amount" for the silica particles in Table 1 refers to an amount thereof relative to 100 parts by mass of the toner mother particles (unit: parts by mass). The term "particle diameter" (parenthesized numeral) for the silica particles refers to a number average primary particle diameter of the silica particles.

TABLE 2

| Suspension | Particle diameter [nm] | Tg [° C.] |
|---|---|---|
| A-1 | 35 | 80 |
| A-2 | 34 | 83 |
| A-3 | 40 | 74 |
| B-1 | 55 | 73 |
| B-2 | 52 | 82 |

The following describes production methods, evaluation methods, and evaluation results of the toners TA-1 to TA-6 and TB-1 to TB-9 in the stated order. In evaluations in which errors may occur, an evaluation value was calculated by calculating the arithmetic mean of an appropriate number of measured values in order to ensure that any errors were sufficiently small. Respective methods for measuring Tg (glass transition point), Mp (melting point), and Tm (softening point) were those described below unless otherwise stated.

<Ta and Mp Measuring Method>

A measuring device used was a differential scanning calorimeter ("DSC-6220" produced by Seiko Instruments Inc.). A heat absorption curve of a sample (for example, a resin) was plotted using the measuring device to determine Tg and Mp of the sample. Specifically, 15 mg of a sample (for example, a resin) was put on an aluminum pan (aluminum vessel) and the aluminum pan was set in a measurement unit of the measuring device. An empty aluminum pan was used as a reference. In plotting the heat absorption curve, the temperature of the measurement unit was increased up to 150° C. from a measurement starting temperature of 10° C. at a rate of 10° C./minute (RUN1). Thereafter, the temperature of the measurement unit was reduced from 150° C. to 10° C. at a rate of 10° C./minute. Subsequently, the temperature of the measurement unit was re-increased to 150° C. from 10° C. at a rate of 10° C./minute (RUN2). Through RUN2, the heat absorption curve of the sample (vertical axis: heat flow (DSC signals), horizontal axis: temperature) was plotted. Mp and Tg of the sample were read from the plotted heat absorption curve. Mp (melting point) of the sample is the temperature of a peak corresponding to a maximum of heat of fusion on the heat absorption curve. Tg (glass transition point) of the sample corresponds to the temperature (onset temperature) at a point of change in specific heat on the heat absorption curve (i.e., an intersection point of an extrapolation of the base line and an extrapolation of the inclined portion of the curve).

<Tm Measuring Method>

An S-shaped curve (horizontal axis: temperature, vertical axis: stroke) of a sample (for example, a resin) was plotted by placing the sample in a capillary rheometer ("CFT-500D" produced by Shimadzu Corporation) and causing melt-flow of 1 $cm^3$ of the sample under conditions of a die pore diameter of 1 mm, a plunger load of 20 $kg/cm^2$, and a heating rate of 6° C./minute. Subsequently, Tm of the sample was read from the plotted S-shaped curve. Tm (softening point) of the sample is a temperature on the S-shaped curve corresponding to a stroke value of $(S_1+S_2)/2$, where $S_1$ represents a maximum stroke value and $S_2$ represents a base line stroke value at low temperatures.

[Toner Production Methods]

(Synthesis of Crystalline Polyester Resin)

A 10-L four-necked flask equipped with a thermometer (thermocouple), a dewatering conduit, a nitrogen inlet tube, and a stirrer was charged with 2,643 g of 1,6-hexanediol, 864 g of 1,4-butanediol, and 2,945 g of succinic acid. The flask contents were then heated up to 160° C. while being stirred for melting the materials in the flask. Subsequently, a mixed liquid of 1,831 g of styrene, 161 g of acrylic acid, and 110 g of dicumyl peroxide was added to the flask dropwise over one hour using a dripping funnel. The flask contents were then caused to react at a temperature of 170° C. for one hour while being stirred for polymerization of the styrene and the acrylic acid in the flask. Thereafter, the flask contents were kept in a reduce atmosphere (pressure of 8.3 kPa) for one hour to remove non-reacted styrene and acrylic acid in the flask. Then, 40 g of tin(II) 2-ethylhexanoate and 3 g of gallic acid were added to the flask. Subsequently, the flask contents were heated to be caused to react at a temperature of 210° C. for eight hours. The flask contents were then caused to react for one hour in a reduced pressure atmosphere (pressure of 8.3 kPa) at a temperature of 210° C. Through the above process, a crystalline polyester resin having a softening point (Tm) of 92° C. and a crystallinity index (=Tm/Mp) of 0.95 was obtained.

(Synthesis of Non-Crystalline Polyester Resin PA)

A 10-L four-necked flask equipped with a thermometer (thermocouple), a dewatering conduit, a nitrogen inlet tube, and a stirrer was charged with 370 g of bisphenol A propylene oxide adduct, 3,059 g of bisphenol A ethylene oxide adduct, 1,194 g of terephthalic acid, 286 g of fumaric acid, 10 g of tin(II) 2-ethylhexanoate, and 2 g of gallic acid. Subsequently, the flask contents were caused to react in a nitrogen atmosphere at a temperature of 230° C. until a reaction ratio became 90% by mass. The reaction ratio was calculated according to an expression "(reaction ratio)=100×(actual amount of reaction product water)/(theoretical amount of reaction product water)". The flask contents were then caused to react in a reduce pressure atmosphere (pressure of 8.3 kPa) at a temperature of 230° C. until a reaction product (resin) had a Tm of a specific temperature (89° C.). Through the above process, a non-crystalline polyester resin PA having a softening point (Tm) of 89° C. and a glass transition point (Tg) of 50° C. was obtained.

(Synthesis of Non-crystalline Polyester Resin PB)

A non-crystalline polyester resin PB was synthesized according to the same method as the non-crystalline polyester resin PA in all aspects other than that 1,286 g of bisphenol A propylene oxide adduct and 2,218 g of bisphenol A ethylene oxide adduct were used as alcoholic components rather than 370 g of bisphenol A propylene oxide adduct and 3,059 g of bisphenol A ethylene oxide adduct and 1,603 g of terephthalic acid was used as an acidic component rather than 1,194 g of terephthalic acid and 286 g of fumaric acid. The resultant non-crystalline polyester resin PB had a softening point (Tm) of 111° C. and a glass transition point (Tg) of 69° C.

(Synthesis of Non-Crystalline Polyester Resin PC)

A 10-L four-necked flask equipped with a thermometer (thermocouple), a dewatering conduit, a nitrogen inlet tube, and a stirrer was charged with 4,907 g of bisphenol A propylene oxide adduct, 1,942 g of bisphenol A ethylene oxide adduct, 757 g of fumaric acid, 2,078 g of dodecyl succinic acid anhydride, 30 g of tin(II) 2-ethylhexanoate, and 2 g of gallic acid. Subsequently, the flask contents were caused to react in a nitrogen atmosphere at a temperature of 230° C. until the reaction ratio expressed by the above expression became 90% by mass. The flask contents were then caused to react for one hour in a reduced pressure atmosphere (pressure of 8.3 kPa) at a temperature of 230° C. Subsequently, 548 g of trimellitic anhydride was added to the flask and the flask contents were caused to react in a reduced pressure atmosphere (pressure of 8.3 kPa) at a temperature of 220° C. until a reaction product (resin) had a Tm of a specific temperature (127° C.). Through the above process, a non-crystalline polyester resin PC having a softening point (Tm) of 127° C. and a glass transition point (Tg) of 51° C. was obtained.

(Preparation of Suspension A-1)

A 1-L three-necked flask equipped with a thermometer, a cooling tube, a nitrogen inlet tube, and a stirring impeller was charged with 90 g of isobutanol, 100 g of methyl methacrylate, 35 g of n-butyl acrylate, 30 g of 2-(methacryloyloxy)ethyl trimethylammonium chloride (product of Alfa Aesar), 6 g of 2,2'-azobis(2-methyl-N-(2-hydroxyethyl)propionamide) ("VA-086" produced by Wako Pure Chemical Industries, Ltd.). Subsequently, the flask contents were caused to react for three hours in a nitrogen atmosphere at a temperature of 80° C. Thereafter, 3 g of 2,2'-azobis(2-methyl-N-(2-hydroxyethyl)propionamide) ("VA-086" produced by Wako Pure Chemical Industries, Ltd.) was added to the flask and the flask contents were caused to react for additional three hours in the nitrogen atmosphere at a temperature of 80° C., thereby obtaining a liquid containing a polymer. The resultant liquid containing the polymer was subsequently dried in a reduced-pressure atmosphere at a temperature of 150° C. The dried polymer was then deagglomerated to obtain a positively chargeable resin.

Subsequently, 200 g of the positively chargeable resin obtained as above and 184 mL of ethyl acetate ("special grade ethyl acetate" produced by Wako Pure Chemical Industries, Ltd.) were added to a vessel of a mixer (HIVIS MIX (registered Japanese trademark) Type 2P-1" produced by PRIMIX Corporation). Then, the vessel contents were stirred for one hour at a rotational speed of 20 rpm using the mixer to obtain a high-viscosity solution. Thereafter, an aqueous solution of ethyl acetate and the like (specifically, an aqueous solution of 562 g of ion-exchanged water in which 18 mL of 1N-hydrochloric acid, 20 g of a cationic surfactant ("TEXNOL (registered Japanese trademark) R5" produced by NIPPON NYUKAZAI CO., LTD., component: alkyl benzyl ammonium salt), and 20 mL of ethyl acetate ("special grade ethyl acetate" produced by Wako Pure Chemical Industries, Ltd.) were dissolved) was added to the resultant high-viscosity solution. Through the above process, a suspension A-1 of resin fine particles was obtained.

(Preparation of Suspension A-2)

A suspension A-2 was prepared according to the same method as the suspension A-1 in all aspects other than that the amount of 2-(methacryloyloxy)ethyl trimethylammonium chloride (product of Alfa Aesar) was changed from 30 g to 40 g.

(Preparation of Suspension A-3)

A suspension A-3 was prepared according to the same method as the suspension A-1 in all aspects other than that the amount of methyl methacrylate was changed from 100 g to 90 g and that of n-butyl acrylate was changed from 35 g to 45 g.

(Preparation of Suspension B-1)

A 1-L three-necked flask equipped with a thermometer and a stirring impeller was set in a water bath, and 875 mL of ion-exchanged water at a temperature of 30° C. and 5 g of an anionic surfactant ("EMAL (registered Japanese trademark) 0", component: sodium lauryl sulfate) were added to the flask. Next, the internal temperature of the flask was increased to 80° C. using the water bath. Two liquids (first and second liquids) were separately added dropwise to the flask at a temperature of 80° C. over five hours. The first liquid was a mixed liquid of 13 mL of styrene, 5 mL of 2-hydroxybutyl methacrylate, and 3 mL of ethyl acrylate. The second liquid was a solution of 30 mL of ion-exchanged water in which 0.5 g of potassium peroxodisulfate was dissolved. The internal temperature of the flask was then kept at 80° C. for additional two hours for polymerization of the flask contents. Through the above process, a suspension B-1 of resin fine particles was obtained.

(Preparation of Suspension B-2)

A suspension B-2 was prepared according to the same method as the suspension B-1 in all aspect other than that a mixed liquid of 13 mL of styrene, 6 mL of 2-hydroxybutyl methacrylate, and 2 mL of ethyl acrylate was used as the first liquid rather than the mixed liquid of 13 mL of styrene, 5 mL of 2-hydroxybutyl methacrylate, and 3 mL of ethyl acrylate.

Table 2 lists number average primary particle diameters and glass transition points (Tg) of the resin fine particles contained in the respective suspensions A-1 to A-3, B-1, and B-2 that were prepared as above. The term "particle diameter" in Table 2 refers to a number average primary particle diameter. The number average primary particle diameters were measured using a transmission electron microscope (TEM). For example, resin fine particles contained in the suspension A-1 had a number average primary particle diameter of 35 nm and a glass transition point (Tg) of 80° C.

(Preparation of External Additive Silica Particles SA-1)

Silica particles SA-1 were obtained by deagglomerating hydrophobic fumed silica particles ("AEROSIL (registered Japanese trademark) R972" produced by Nippon Aerosil Co., Ltd., hydrophobizing agent: dimethyldichlorosilane (DDS), number average primary particle diameter: 16 nm, BET specific surface area: approximately 110 $m^2/g$) using a jet mill ("Model-I Super Sonic Jet Mill" produced by Nippon Pneumatic Mfg. Co., Ltd.).

(Preparation of External Additive Silica Particles SA-2)

Hydrophobic fumed silica particles ("AEROSIL R972" produced by Nippon Aerosil Co., Ltd.) were prepared as silica particles SA-2. The hydrophobic fumed silica particles (AEROSIL R972) that had not been deagglomerated were used directly.

(Preparation of External Additive Silica Particles SB)

Silica particles SB were obtained by deagglomerating hydrophilic fumed silica particles ("AEROSIL 50" produced by Nippon Aerosil Co., Ltd., surface treatment: not subjected, number average primary particle diameter: 30 nm, BET specific surface area: approximately 50 $m^2/g$) using a jet mill ("Model-I Super Sonic Jet Mill" produced by Nippon Pneumatic Mfg. Co., Ltd.).

(Preparation of External Additive Silica Particles SC)

Silica particles SC were obtained by deagglomerating hydrophobic fumed silica particles ("AEROSIL R812" produced by Nippon Aerosil Co., Ltd., hydrophobizing agent: hexamethyldisilazane (HMDS), number average primary particle diameter: 7 nm, BET specific surface area: approximately 260 $m^2/g$) using a jet mill ("Model-I Super Sonic Jet Mill" produced by Nippon Pneumatic Mfg. Co., Ltd.).

(Preparation of External Additive Silica Particles SD)

Silica particles SD were obtained by deagglomerating hydrophilic fumed silica particles ("AEROSIL OX 50" produced by Nippon Aerosil Co., Ltd., surface treatment: not subjected, number average primary particle diameter: 40 nm, BET specific surface area: approximately 50 $m^2/g$) using a jet mill ("Model-I Super Sonic Jet Mill" produced by Nippon Pneumatic Mfg. Co., Ltd.).

(Preparation of External Additive Cross-Linked Resin Particles)

A 3-L flask equipped with a stirrer, a nitrogen inlet tube, a thermometer, and a condenser (heat exchanger) was charged with 1,000 g of ion-exchanged water and 4 g of a cationic surfactant ("Texnol R5" produced by NIPPON NYUKAZAI CO., LTD., component: alkyl benzyl ammonium salt), and nitrogen substation was performed for 30 minutes. The alkyl benzyl ammonium salt is thought to function as an emulsifier.

Subsequently, 2 g of potassium peroxodisulfate was added to the flask and dissolved while the flask contents were stirred. Next, the temperature of the flask contents was increased to 80° C. in a nitrogen atmosphere while the flask contents were stirred. When the temperature of the flask contents reached at 80° C., dripping of a mixture of 250 g of methyl methacrylate and 4 g of 1,4-butanediol dimethacrylate into the flask was started and the mixture was thoroughly dripped over two hours while the flask contents were stirred at a rotational speed of 300 rpm. After the dripping, the flask contents were stirred for additional eight hours while being kept at 80° C. The flask contents were then cooled to normal temperature (approximately 25° C.), thereby obtaining an emulsion of cross-linked resin particles. The resultant emulsion was then dried to obtain the cross-linked resin particles (powder). The resultant cross-linked resin particles had a number average primary particle diameter of 84 nm and a glass transition point (Tg) of 114° C.

(Toner Core Production)

An FM mixer (product of Nippon Coke & Engineering Co., Ltd.) was used to mix 100 g of a first binder resin (crystalline polyester resin synthesized by the above-described process), 300 g of a second binder resin (non-crystalline polyester resin PA synthesized by the above-described process), 100 g of a third binder resin (non-crystalline polyester resin PB synthesized by the above-described process), 600 g of a fourth binder resin (non-crystalline polyester resin PC synthesized by the above-described process), 12 g of a first releasing agent ("Carnauba Wax No. 1" produced by S. Kato & Co., component: carnauba wax), 48 g of a second releasing agent ("NISSAN ELECTOR (registered Japanese trademark) WEP-3" produced by NOF Corporation, component: ester wax), and 144 g of a colorant ("COLORTEX (registered Japanese trademark) Blue B1021" produced by SANYO COLOR WORKS, Ltd., component: Phthalocyanine Blue) at a rotational speed of 2,400 rpm.

The resultant mixture was then melt-knead using a twin-screw extruder ("PCM-30" produced by Ikegai Corp.) under conditions of a material feeding speed of 5 kg/hour, a shaft rotational speed of 160 rpm, and a set temperature (cylinder temperature) of 100° C. The resultant melt-knead product was then cooled. The cooled melt-kneaded product was then coarsely pulverized using a pulverizer ("ROTOPLEX (registered Japanese trademark) 16/8" produced by former Toa Machinery Mfg.). The resultant coarsely pulverized product was finely pulverized using a jet mill ("Model-I Super Sonic Jet Mill" produced by Nippon Pneumatic Mfg. Co., Ltd.). The resultant finely pulverized product was next classified using a classifier ("Elbow Jet EJ-LABO" produced by Nittetsu Mining Co., Ltd.). As a result, toner cores having a glass transition point (Tg) of 36° C. and a volume median diameter ($D_{50}$) of 6 μm were obtained.

(Shell Layer Formation Process)

A 1-L three-necked flask equipped with a thermometer and a stirring impeller was set in a water bath and 300 mL of ion-exchanged water was added to the flask. The internal temperature of the flask was then kept at 30° C. using the water bath. The pH of the flask contents was then adjusted to 4 by adding dilute hydrochloric acid to the flask. Subsequently, a shell material (suspension defined for corresponding one of the toners in Table 1) was added to the flask in the amount corresponding to that indicated in Table 1. For example, 10 mL of the suspension A-1 and 20 mL of the suspension B-1 were added to the flask separately as the shell material in production of the toner TA-1.

Subsequently, 300 g of the toner cores (toner core produced by the above-described process) were added to the flask. The flask contents were then stirred for one hour at a rotational speed of 300 rpm. Thereafter, 300 mL of ion-exchanged water was added to the flask. The flask contents were then heated at a rate of 1° C./minute while being stirred at a rotational speed of 100 rpm. When the flask contents reached at 78° C., the pH of the flask contents was adjusted to 7 by adding sodium hydroxide to the flask. Subsequently, the flask contents were cooled to normal temperature (approximately 25° C.), thereby obtaining a dispersion containing toner mother particles.

(Washing Process)

Filtration (solid-liquid separation) of the dispersion of the toner mother particles obtained as above was performed using a Buchner funnel, thereby collecting a wet cake of the toner mother particles. Thereafter, the collected wet cake of the toner mother particles was re-dispersed in ion-exchanged water. Re-dispersion and filtration were repeated additional five times to wash the toner mother particles.

(Drying Process)

Next, the resultant toner mother particles were dispersed in an ethanol solution at a concentration of 50% by mass. Through the dispersion, a slurry of the toner mother particles was obtained. The toner mother particles in the slurry were dried using a continuous surface-modifying apparatus ("COATMIZER (registered Japanese trademark)" produced by Freund Corporation) under conditions of a hot air temperature of 45° C. and a flow rate of 2 $m^3$/minute.

(External Addition Process)

Subsequently, 100 parts by mass of the toner mother particles, 1.25 parts by mass of the resin particles (cross-linked resin particles prepared through the above-described process), silica particles (silica particles SA-1, SA-2, SB, SC, or SD defined for the respective toners listed in Table 1), and 1.00 part by mass of conductive titanium oxide particles ("EC-100" produced by Titan Kogyo, Ltd., base material: $TiO_2$, coat layer: Sb-doped $SnO_2$ film, number average primary particle diameter: approximately 0.36 μm) were mixed for a corresponding one of the time periods listed in Table 1 (external addition time) under a corresponding one of the temperature conditions (external addition temperature) listed in Table 1 using a 10-L FM mixer (product of Nippon Coke & Engineering Co., Ltd.). The amount of the silica particles was a corresponding one of those listed in Table 1. For example, 1.25 parts by mass of the resin particles, 1.50 parts by mass of the silica particles SA-1, and 1.00 part by mass of the conductive titanium oxide particles were added to 100 parts by mass of the toner mother particles and the resultant substance was mixed at a temperature of 25° C. for ten minutes using the FM mixer in production of the toner TA-1. Through the above mixing, the external additive (resin particles, silica particles, and titanium oxide particles) were attached to the surfaces of the toner mother particles. Thereafter, sifting was performed using a 200 mesh sieve (opening 75 μm). As a result, a toner (corresponding one of the toners TA-1 to TA-6 and TB-1 to TB-9 listed in Table 1) including multiple toner particles was produced.

Table 3 lists measurement result of the shell coverages and the surface potentials for the toner particles in the respective toners TA-1 to TA-6 and TB-1 to TB-9 produced as above. The sign for "surface potential (unit: mV)" in Table 3 is "positive". For example, the toner TA-1 had a shell coverage of 70%, an average value of the surface potentials of +182 mV, and a standard deviation of the surface potentials of 62 mV

TABLE 3

| | Surface potential [mV] | | Shell | Silica particles (external additive) | |
|---|---|---|---|---|---|
| Toner | Average | Standard deviation | coverage [%] | Agglomeration | Adhesion |
| TA-1 | 182 | 62 | 70 | No | Non-cover/ Cover 2 |
| TA-2 | 241 | 55 | 88 | No | Non-cover/ Cover 2 |
| TA-3 | 109 | 90 | 47 | No | Non-cover/ Cover 2 |
| TA-4 | 344 | 91 | 61 | No | Non-cover/ Cover 2 |
| TA-5 | 51 | 88 | 43 | No | Non-cover/ Cover 2 |
| TA-6 | 134 | 117 | 70 | No | Non-cover/ Cover 2 |
| TB-1 | 226 | 49 | 92 | No | Non-cover/ Cover 2 |
| TB-2 | 73 | 106 | 39 | No | Non-cover/ Cover 2 |
| TB-3 | 356 | 69 | 88 | Yes | Insufficient |
| TB-4 | 46 | 92 | 47 | No | Non-cover/ Cover 2 |
| TB-5 | 166 | 123 | 70 | Yes | Insufficient |
| TB-6 | 158 | 137 | 70 | Yes | Insufficient |
| TB-7 | 129 | 123 | 70 | Yes | Insufficient |
| TB-8 | 149 | 130 | 74 | No | Non-cover/ Cover 1/Cover 2 |
| TB-9 | 125 | 137 | 80 | No | Non-cover/ Cover 1/Cover 2 |

Table 3 further indicates respective results of measurement for states of the silica particles (external additive) attached to the surfaces of the toner particles. The adhereing states of the silica particles were determined by observing the surfaces of the toner particles using a scanning electron microscope (SEM). In the column "Adhesion" for the silica particles in Table 3: "Non-cover" refers to the non-covered region (surface region of a toner core not covered with a shell layer); "Cover 1" refers to the first covered region (specifically, surface region of a toner core covered with a shell layer domain formed in any of the suspensions A-1 to A-3); and "Cover 2" refers to the second covered region (specifically, surface region of a toner core covered with a shell layer domain formed in either of the suspension B-2 or B-2). In the column "Agglomeration" for the silica particles in Table 3, "Yes" refers to occurrence of agglomeration for the silica particles as illustrated in FIG. 4 and "No" refers to non-occurrence of agglomeration thereof.

The shell layers of the toners TA-1 to TA-6 and TB-1 to TB-9 each are a film as a result of integration of the first domain (shell layer domain formed in corresponding one of the suspensions A-1 to A-3) and the second domain (shell layer domain formed in corresponding one of the suspensions B-1 and B-2). The silica particles (external additive) were selectively present in the non-covered region and the second covered region of the entire surface region of each toner core in the respective toners TA-1 to TA-6 (see FIG. 2), as listed in Table 3. A considerable amount of the silica particles (external additive) were present also in the first covered region in addition to the non-covered region and the second covered region in both of the toners TB-8 and TB-9, as listed in Table 3. As further listed in Table 3, a non-covered region insufficiently covered with the silica particles was present as an exposed core region (surface region of a toner core covered with neither the shell layer nor the silica particles), as illustrated in previously mentioned FIG. 4, in the toner cores in the toners TB-3 and TB-5 to TB-7.

The shell coverages and the surface potentials of the respective toner particles were measured by the following methods.

<Shell Coverage Measuring Method>

Toner mother particles (toner without external additive) of a sample (toner) were measured as a measurement target. The toner mother particles (powder) were dyed with Ru (ruthenium) by exposing the toner mother particles to vapor of 2 mL of a $RuO_4$ aqueous solution at a concentration of 5% by mass in an air atmosphere at normal temperature (25° C.) for 20 minutes. A backscattered electron image of a dyed toner mother particle was captured using a field effect scanning electron microscope (FE-SEM) ("JSM-7600F" produced by JEOL Ltd.). A region of the surface region of the toner core covered with the shell layer tended to be readily dyed with ruthenium. A region of the surface region of the toner mother particle that was dyed with Ru (dyed region) was seen brighter than a region not dyed with Ru (non-dyed region). Conditions set in the FE-SEM for capture were an accelerating voltage of 10.0 kV, an illumination electric current of 95 pA, a WD (work distance) of 7.8 mm, a magnification of 5,000×, a contrast of 4,800, and a brightness of 550.

Subsequently, image analysis was performed on the backscattered electron image using image analysis software ("WinROOF" produced by Mitani Corporation). Specifically, the backscattered electron image was converted to image data in the format of jpg and subjected to processing using a 3×3 Gaussian filter. A luminance histogram (vertical axis: frequency (number of pixels), horizontal axis: luminance) of the filtered image data was then plotted. The luminance histogram showed a luminance distribution of the surface region (dyed region and non-dyed region) of the toner mother particle. Fitting to a normal distribution by a least-squares method and waveform separation were performed on the plotted luminance histogram to obtain waveforms of the non-dyed region showing a luminance distribution (normal distribution) of the non-dyed region (non-covered region: surface region of the toner core not covered with the shell layer) and waveforms of the dyed region showing a luminance distribution (normal distribution) of the dyed region (shell covering region: surface region of the toner core covered with the shell layer). Subsequently, the shell coverage (unit: %) was calculated from areas of the obtained waveforms (area $R_c$ of the waveforms of the non-dyed region and area $R_s$ of the waveforms of the dyed region) based on the following expression.

$$(\text{Shell coverage})=100\times R_S/(R_C+R_S)$$

<Surface Potential Measuring Method>

The measuring device used was a scanning probe station ("NanoNaviReal" produced by Hitachi High-Tech Science Corporation) including a scanning probe microscope (SPM) ("Multi-purpose unit AFM5200S" produced by Hitachi High-Tech Science Corporation). The toner particles included in a sample (toner) were set on a measurement table (columnar conductive base) of the measuring device (SPM). Specifically, a conductive carbon tape was attached to the measurement table and the sample (toner) that had been positively charged were sprayed onto the carbon tape and fixed. Note that the sample (toner) was positively charged in a manner that the toner was set in a mixer ("TURBULA (registered Japanese trademark) mixer produced by Willy A. Bachofen AG (WAB)) together with a developer carrier (carrier for "TASKalfa5550ci" produced by KYOCERA Document Solutions Inc.) and stirred using the mixer in an environment at a temperature of 25° C. and a relative humidity of 60% for 30 minutes. After the stirring, a developer (toner and carrier) was taken out from the vessel of the ball mill using a neodymium magnet. Only the toner in the developer was sprayed onto the carbon tape by spraying gas toward the developer attached to the magnet using a blower. A toner particle among the toner particles on the carbon tape that was sufficiently separate from the other toner particles and in an average state was selected as a measurement target using an optical microscope. The toner particle sufficiently separate from the other toner particles was selected in order to avoid static influence on the selected toner particle from the other toner particles.

(Conditions of SPM measurement)

Movable range of measurement unit (measurable sample size): 100 μm (Small Unit).

Measurement prove: Cantilever ("SI-DF3-R" produced by Hitachi High-Tech Science Corporation, tip diameter: 30 nm, prove coating material: rhodium (Rh), spring constant: 1.7 N/m, resonance frequency: 27 kHz).

Measurement mode: Kelvin probe force microscopy (KFM) mode/cyclic contact mode.

Measurement range (per field of view): 1μm×1 μm.

Resolution (X data/Y data): 256/256.

Amplitude extinction ratio: −0.499.

Scanning frequency: 0.10 Hz.

Excitation voltage: 2.002 V.

Trace height (distance between measurement target and probe): 49.95 nm.

Trace delay: 50 milliseconds.

Signal magnification: 10×.

A KFM image of a toner particle (image showing a surface potential distribution) was captured by bringing the probe to the top of the toner particle in the above measurement mode (KFM mode/cyclic contact mode). The average value and the standard deviation of the surface potentials of the toner particles were measured based on the captured KFM image (number of data: 256×256 pieces/$\mu m^2$). The respective surface potentials (averages and standard deviations) of ten toner particles included in a sample (toner) were measured. The number average value of the ten toner particles was determined as an evaluation value (average and standard deviation of the surface potentials) of the sample (toner).

[Evaluation Methods]

The samples (toners TA-1 to TA-6 and TB-1 to TB-9) were evaluated according to the following evaluation methods.

(Heat-Resistant Preservability)

A 20-mL polyethylene vessel was charged with 2 g of a sample (toner) and left to stand for three hours in a constant temperature bath set at a temperature of 58° C. The toner taken out from the constant temperature bath was then cooled to room temperature (approximately 25° C.), thereby obtaining an evaluation toner.

The resultant evaluation toner was placed on a 100-mesh sieve (opening: 150 μm) having a known mass. The mass of the toner prior to sifting was calculated by measuring the total mass of the sieve and the evaluation toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. The mass of the toner remaining on the sieve was calculated by measuring the total mass of the sieve and the evaluation toner thereon after the sifting. The mass of the toner before the sifting and the mass of toner after the sifting (i.e., mass of toner that remained on the sieve) were used to calculate a degree of aggregation (unit: % by mass) based on the following expression.

(Degree of aggregation)=100×(mass of toner after sifting)/(mass of toner before sifting).

A toner having a degree of aggregation of no greater than 50% by mass was evaluated as good (Good). A toner having a degree of aggregation of greater than 50% by mass was evaluated as poor (Poor).

(Preparation of Two-component Developer)

A ball mill was used to mix 100 parts by mass of a developer carrier (carrier for "TASKalfa5550ci" produced by KYOCERA Document Solutions Inc.) and 10 parts by mass of a sample (toner) for 10 minutes, thereby preparing a two-component developer.

(Minimum Fixable Temperature)

The evaluation was performed using a color printer ("FS-C5250DN", product of KYOCERA Document Solutions Inc., modified to enable adjustment of fixing temperature) including a roller-roller type heat pressure fixing device as an evaluation apparatus. The two-component developer prepared through the above-described process was loaded into a developing device of the evaluation apparatus, and a sample (toner for replenishment use) was loaded into a toner container of the evaluation apparatus.

A solid image (specifically, non-fixed toner image) having a size of 25 mm×25 mm was formed on paper having a basis weight of 90 g/m$^2$ (A4-size printing paper) under conditions of a linear velocity of 200 mm/second and a toner applied amount of 1.0 mg/cm$^2$ in an environment at a temperature of 25° C. and a relative humidity of 50%. Subsequently, the paper with the image thereon was passed through the fixing device of the evaluation apparatus.

The measurement range of the fixing temperature ranged from 100° C. to 200° C. in evaluation of minimum fixable temperature. Specifically, a lowest temperature (minimum fixable temperature) at which the solid image (toner image) was enabled to be fixed to the paper was measured while the fixing temperature of the fixing device was increased from 100° C. in increments of 5° C. (in increments of 2° C. around the minimum fixable temperature). Whether or not the toner was fixed was confirmed by a fold-rubbing test described below. Specifically, the evaluation paper having passed through the fixing device was folded in half such that a surface with the solid image thereon was folded inwards and the fold was rubbed using a 1-kg weight covered with cloth back and forth five times. Next, the paper was opened up and a fold portion (i.e., a portion to which the solid image was formed) of the paper was observed. The length of toner peeling of the fold portion (peeling length) was measured. The lowest temperature was determined to be a minimum fixable temperature among temperatures for which the peeling length was no greater than 1 mm. A toner having a minimum fixable temperature of no higher than 145° C. was evaluated as good (Good). A toner having a minimum fixable temperature of higher than 145° C. was evaluated as poor (Poor).

(Fogging Density in High-Temperature and High-Humidity Environment)

A color multifunction peripheral ("TASKalfa5550ci" produced by KYOCERA Document Solutions Inc.) was used as an evaluation apparatus. The two-component developer prepared through the above-described process was loaded into a developing device of the evaluation apparatus, and a sample (toner for replenishment use) was loaded into a toner container of the evaluation apparatus. The evaluation apparatus set to have a voltage (ΔV) between a developing sleeve and a magnet roll thereof of approximately 250 V was left to stand for 12 hours in an environment at a temperature of 32.5° C. and a relative humidity of 80.0%. Subsequently, a sample image including a solid portion and a blank portion was printed on a recording medium (evaluation paper) using the evaluation apparatus in an environment at a temperature of 32.5° C. and a relative humidity of 80.0%. The reflection density of each of the blank portion of the sample image on the printed recording medium and base paper not subjected to printing (non-printed paper) was measured using a reflectance densitometer (SPECTRO EYE (registered Japanese trademark)" produced by X-Rite Inc.). The fogging density (FD) was then calculated based on the following expression.

FD=(reflection density of blank portion)−(reflection density of non-printed paper)

A toner having a fogging density (FD) of no greater than 0.005 was evaluated as good (Good), and a toner having a fogging density of greater than 0.005 was evaluated as poor (Poor).

(Developability in Low-Temperature and Low-Humidity Environment)

A color multifunction peripheral ("TASKalfa5550ci" produced by KYOCERA

Document Solutions Inc.) was used as an evaluation apparatus. The two-component developer prepared through the above-described process was loaded into a developing device of the evaluation apparatus, and a sample (toner for replenishment use) was loaded into a toner container of the evaluation apparatus. The evaluation apparatus set to have a voltage (ΔV) between a developing sleeve and a magnet roll thereof of approximately 250 V was left to stand for 12 hours in an environment at a temperature of 10° C. and a relative humidity of 10.0%. Subsequently, a sample image including a solid portion and a blank portion was printed on a recording medium (evaluation paper) using the evaluation apparatus in an environment at a temperature of 10° C. and a relative humidity of 10%. The image density (ID) of the solid portion of the sample image on the printed recording medium was measured using a reflectance densitometer ("SpectroEye" produced by X-Rite Inc.).

A toner having an image density (ID) of at least 0.80 and no greater than 1.20 was evaluated as good (Good), and a toner having an image density (ID) of less than 0.80 or greater than 1.20 was evaluated as poor (Poor).

[Evaluation Results]

Table 4 lists evaluation results of heat-resistant preservability (degree of aggregation), low-temperature fixability (minimum fixable temperature), fogging density, and developability (image density) for the toners TA-1 to TA-6 and TB-1 to TB-9. Note that the evaluation result of developability for the toner TB-3 was significantly poor and therefore the fogging density was not evaluated for the toner TB-3.

TABLE 4

| | Toner | Heat-resistant perservability [% by mass] | Low-temperature fixability [° C.] | Fogging density | Develop-ability (ID) |
|---|---|---|---|---|---|
| Example 1 | TA-1 | 21 | 132 | 0.002 | 1.03 |
| Example 2 | TA-2 | 5 | 140 | 0.001 | 0.93 |
| Example 3 | TA-3 | 38 | 122 | 0.003 | 1.13 |
| Example 4 | TA-4 | 22 | 130 | 0.001 | 0.82 |
| Example 5 | TA-5 | 35 | 122 | 0.005 | 1.10 |
| Example 6 | TA-6 | 25 | 132 | 0.005 | 1.02 |
| Comparative Example 1 | TB-1 | 2 | 146 (Poor) | 0.001 | 0.99 |
| Comparative Example 2 | TB-2 | 54 (Poor) | 120 | 0.004 | 1.08 |
| Comparative Example 3 | TB-3 | 5 | 142 | — | 0.76 (Poor) |
| Comparative Example 4 | TB-4 | 44 | 120 | 0.020 (Poor) | 1.02 |
| Comparative Example 5 | TB-5 | 35 | 128 | 0.014 (Poor) | 0.98 |
| Comparative Example 6 | TB-6 | 36 | 126 | 0.015 (Poor) | 0.92 |
| Comparative Example 7 | TB-7 | 30 | 128 | 0.015 (Poor) | 1.04 |
| Comparative Example 8 | TB-8 | 41 | 124 | 0.012 (Poor) | 0.91 |
| Comparative Example 9 | TB-9 | 45 | 120 | 0.015 (Poor) | 0.90 |

The toners TA-1 to TA-6 (toners of Examples 1 to 6) each had the above basic features. Specifically, the toners TA-1 to TA-6 each include a plurality of toner particles each including a toner mother particle (toner core and shell layer) and silica particles attached to a surface of the toner mother particle. The shell layer included a first domain substantially formed from a first resin and a second domain substantially formed from a second resin. Both the first resin and the silica particles had higher positive chargeability than the second resin. Specifically, the first resin was a copolymer of methyl methacrylate, n-butyl acrylate, and 2-(methacryloyloxy) ethyl trimethylammonium chloride. The second resin was a copolymer of styrene, 2-hydroxybutyl methacrylate, and ethyl acrylate. The silica particles were hydrophobic silica particles (hydrophobizing agent: dimethyldichlorosilane) or non-treated silica particles (silica base). As indicated in Table 3, the shell coverage (ratio of total area of first and second covered regions relative to area of entire surface of toner core) was at least 40% and no greater than 90%. As further indicated in Table 3, the toner particle has an average of the surface potentials measured using a scanning probe microscope of at least +50 mV and no greater than +350 mV and a standard deviation thereof of no greater than120 mV.

As listed in Table 4, the toners TA-1 to TA-6 each were excellent in heat-resistant preservability and low-temperature fixability and a high-quality image (specifically, an image having high dot reproducibility and low fogging density) can be formed with the use of any of the toners TA-1 to TA-6.

INDUSTRIAL APPLICABILITY

The electrostatic latent image developing toner according to the present invention can be used for example for image formation using a copier, a printer, or a multifunction peripheral.

The invention claimed is:

1. An electrostatic latent image developing toner comprising a plurality of toner particles each including a toner mother particle and silica particles attached to a surface of the toner mother particle, wherein the toner mother particle includes a core containing a binder resin and a shell layer covering a surface of the core, the shell layer includes a first domain substantially formed from a first resin and a second domain substantially formed from a second resin, both the first resin and the silica particles have higher positive chargeability than the second resin, a ratio of a total area of a first covered region and a second covered region relative to an area of an entire surface of the core is at least 40% and no greater than 90%, the first covered region being a surface region of the core that is covered with the first domain, the second covered region being a surface region of the core that is covered with the second domain, and the toner particles each have an average value of surface potentials measured using a scanning probe microscope of at least +50 mV and no greater than +350 mV and a standard deviation thereof of no greater than 120 mV.

2. The electrostatic latent image developing toner according to claim 1, wherein the shell layer is a film as a result of integration of the first and second domains, and the silica particles are selectively present in the second covered region and a non-covered region of the entire surface of the core, the non-covered region being a surface region of the core that is covered with neither the first domain nor the second domain.

3. The electrostatic latent image developing toner according to claim 2, wherein resin particles having a particle diameter of at least 50 nm and no greater than 150 nm are additionally attached to the surface of the toner mother particle, the resin particles being substantially formed from a third resin different from the first and second resins, and the third resin forming the resin particles is more hardly triboelectrically charged than both the first resin and the silica particles.

4. The electrostatic latent image developing toner according to claim 3, wherein the third resin is a cross-linked acrylic acid-based resin.

5. The electrostatic latent image developing toner according to claim 1, wherein the first resin has a glass transition point of at least 80° C., the silica particles have a number average primary particle diameter of at least 10 nm and no greater than 30 nm, and both the first resin and the silica particles have higher positive chargeability than the binder resin.

6. The electrostatic latent image developing toner according to claim 5, wherein the silica particles each have no amino group on a surface thereof, and the core contains either or both a polyester resin and styrene-acrylic acid-based resin as the binder resin.

7. The electrostatic latent image developing toner according to claim 6, wherein the core is a pulverized core, the core contains a crystalline polyester resin and a non-crystalline polyester resin as the binder resin, and inorganic particles other than the silica particles are additionally attached to the surface of the toner mother particle.

8. The electrostatic latent image developing toner according to claim 6, wherein the first resin includes at least one repeating unit derived from a nitrogen-containing vinyl compound, and the second resin includes in chemical structure thereof no nitrogen atom and a repeating unit having at least one group selected from the group consisting of an ether group, a carbonyl group, an acid group, and a hydroxyl group.

9. The electrostatic latent image developing toner according to claim 8, wherein the first resin is an acrylic acid-based resin including at least one repeating unit derived from a (meth)acryloyl group-containing quaternary ammonium compound, and the second resin is a polymer of monomers including at least one styrene-based monomer and at least one acrylic acid-based monomer.

10. The electrostatic latent image developing toner according to claim 9, wherein the second resin includes at least one repeating unit having an alcoholic hydroxyl group.

* * * * *